US005979319A

United States Patent [19]

Hamaoka et al.

[11] Patent Number: 5,979,319

[45] Date of Patent: Nov. 9, 1999

[54] INK FEEDER OF A PRINTING PRESS AND INK SCRAPER WITH SEPARATED INK GUIDE

[75] Inventors: Yukio Hamaoka; Yoshihiro Oyama; Koji Mita, all of Mihara; Mitsunao Miyake, Tokyo, all of Japan

[73] Assignee: Mitsubishi Jukogo Kabushiki Kaisha, Tokyo, Japan

[21] Appl. No.: 08/913,337

[22] PCT Filed: Jan. 9, 1997

[86] PCT No.: PCT/JP96/00024

§ 371 Date: Sep. 11, 1997

§ 102(e) Date: Sep. 11, 1997

[87] PCT Pub. No.: WO97/25210

PCT Pub. Date: Jul. 17, 1997

[30] Foreign Application Priority Data

| | | | |
|---|---|---|---|
| Jan. 11, 1996 | [JP] | Japan | 8-3018 |
| Feb. 27, 1996 | [JP] | Japan | 8-131717 |
| May 2, 1996 | [JP] | Japan | 8-111600 |
| May 24, 1996 | [JP] | Japan | 8-129925 |

[51] Int. Cl.[6] ..... B41F 31/03; B41F 31/20

[52] U.S. Cl. ..... 101/350.1; 101/350.5; 101/363; 101/207

[58] Field of Search ..... 101/206, 207, 101/208, 366, 350.1, 350.5, 363, 350.2

[56] References Cited

U.S. PATENT DOCUMENTS

| | | | |
|---|---|---|---|
| 355,590 | 2/1887 | Nakano et al. . | |
| 1,574,474 | 2/1926 | Faltus | 101/365 |
| 2,161,943 | 6/1939 | Baue | 161/365 |
| 2,837,024 | 6/1958 | Dougan | 101/365 |
| 3,585,932 | 6/1971 | Granger | 101/351.7 |
| 3,699,888 | 10/1972 | Easoz | 101/365 |
| 5,205,216 | 4/1993 | Okamura et al. | 101/350.5 |
| 5,709,148 | 1/1998 | Uera et al. | 101/365 |

FOREIGN PATENT DOCUMENTS

| | | |
|---|---|---|
| 2-113945 | 4/1990 | Japan . |
| 2-295744 | 12/1990 | Japan . |
| 3-258545 | 11/1991 | Japan . |
| 4-344245 | 11/1992 | Japan . |
| 5-147199 | 6/1993 | Japan . |
| 1082666 | 9/1967 | United Kingdom . |

*Primary Examiner*—Edgar Burr
*Assistant Examiner*—Daniel J. Colilla
*Attorney, Agent, or Firm*—Wenderoth, Lind & Ponack, L.L.P.

[57] ABSTRACT

An ink feeder comprises a plurality of ink tanks for storing inks and wetting water, disposed in a transverse direction of an ink fountain roller, a vane wheel disposed at the bottom of an ink tank, an ink pump for feeding ink, an ink feed blade for adjusting the quantity of ink supplied from the ink pump to the ink fountain roller to a constant value, and a coupling for transmitting the driving force of a single motor to the vane wheel and the ink pump provided to each ink tank. The ink tanks, the ink pump, the ink feed nozzle, the ink feed pipe and the ink feed blade mechanism may be built into one unit, and this unit can be fitted to and removed from the main body of the printing press. The ink feeder may be equipped with an ink scraper comprising scraped ink separators arranged parallel in the axial direction of the scraping doctor support device. Each of the scraped ink separators may include an ink guide plate for guiding the ink scraped from the surface of the doctor roller, provided at the bottom, and color mixture preventive walls for preventing mixture of adjacent inks, provided on both sides of the guide plate.

16 Claims, 14 Drawing Sheets

INK FEEDER OF A PRINTING PRESS AND INK SCRAPER WITH SEPARATED INK GUIDE

BACKGROUND OF THE INVENTION

1. Field of the Invention

The present invention relates to an apparatus for feeding a high consistency fluid onto a rotating face, more specifically an ink feeder and an ink scraper most suitable for use in an offset rotary press.

2. Description of the Prior Art

An apparatus for feeding a high consistency fluid onto a rotating face comprises an ink feeder for feeding ink onto a printing plate.

FIG. 24 is a partial side view showing structure of one color part of an offset rotary press in the prior art which prints using a so-called keyless ink feeder. As shown in FIG. 24, there is provided an ink fountain roller 1 which is driven by a motor which is able to conduct speed control independent of a main body of the printing machine so as to rotate the roller 1 at a speed which is lower than that of the main body of the printing machine so that ink can be transferred. Ink of a constant film thickness is fed onto an outer circumferential surface of the ink fountain roller 1 from a portion of an ink feed blade 12 which is disposed along the axial direction (widthwise direction) of the ink fountain roller 1, or the cross machine direction. Also, there is maintained a gap of a predetermined distance between the ink feed blade 12 and the surface of the ink fountain roller 1 during printing.

In the prior art ink feed blade 12, as used in the keyless ink feeder for a high consistency fluid, there is no ink feed blade sectioned in the widthwise direction of the ink fountain roller 1. Color change in the widthwise direction of the ink fountain roller 1 thus cannot be effected.

So, an ink feed blade 12 in which a plurality of ink tanks 2 are provided in the widthwise direction of the ink fountain roller 1 so as to be sectioned to each feed ink uniformly in the widthwise direction onto the ink fountain roller 1 has been provided.

In FIG. 24, there is provided an ink transfer roller 3 which is driven to rotate at the same speed as that of the main body of the printing machine. The ink transfer roller 3 and the ink fountain roller 1 which is fed with ink are urged toward each other so that, while slippage between both rollers is being effected at a nip portion thereof, slip metering is taking place and the ink is transferred onto the ink transfer roller 3. Then, the ink is fed from the ink transfer roller 3 to a roller group 4 comprising a plurality of rollers and is further fed onto a printing plate 6 which is attached to an outer circumferential surface of a plate cylinder 45 via a form roller 5 in the roller group 4.

In the case of an offset printing, the printing plate 6 is also fed with damping water from a damping device 29 in addition to the ink fed as mentioned above.

The ink as fed onto the printing plate 6 via the ink fountain roller 1, the ink transfer roller 3 and the roller group 4 is fed with a constant film thickness in the cross machine direction. The ink is further transferred from the printing plate 6 to a blanket cylinder 46 so that printing is made on a paper running between the blanket cylinder 46 and another blanket cylinder 46 disposed opposingly thereto.

There is a portion where no printing is made, that is, a portion where no ink is fed onto the printing plate 6 from the form roller 5. Therefore, although the ink of a constant film thickness is fed, that ink is not consumed and the ink film thickness corresponding to that portion on the outer circumferential surfaces of the roller group 4, etc. becomes thicker.

So, a scraping doctor 8 is caused to abut on a doctor roller 7 disposed in the roller group 4. By use of this scraping doctor 8, the ink at the portion of the roller group 4 where the film thickness becomes thicker is scraped so that the ink is consumed uniformly in the entire widthwise direction of the roller group 4. Thus even if ink is fed constantly in the widthwise direction of the roller group 4, it is consumed with a good balance, and even though there occurs a differential ink consumption locally during the printing, a uniform ink film thickness is maintained in the cross machine direction.

In such keyless inking in which ink is fed without use of an ink quantity regulating mechanism divided into small sections in the cross machine direction, it has been a large problem as to how high consistency ink can be used to obtain high quality printed matter.

In order to solve this problem, an apparatus for realizing a high quality printing is disclosed by Japanese utility model application No. Hei 2(1990)-8147 titled "Ink receiving tank for keyless inking apparatus".

In the apparatus, as illustrated in FIG. 24, a shaft 9 fitted with a spirally formed plate (hereinafter referred to as "vane wheel 9") is disposed at a bottom portion of the ink tank 2, and by use of this vane wheel 9, ink is fed to an opening portion of an ink suction pipe 44 of an ink pump 10 disposed at the bottom portion of the ink tank 2.

It is to be noted that the ink received in the ink tank 2 contains water, which has been fed from the damping device 29 onto the printing plate 6, either transmitted on the surfaces of the roller group 4 etc. or scraped in the form of a mixture in the ink. The vane wheel 9 has at the same time a function of agitating the water mixed in the ink in the ink tank 2 for the purpose of homogenization.

As for the vane wheel 9 driven in the ink tank 2, as shown in FIG. 25 an independent drive motor 50 is provided, and this drive motor 50 is arranged in parallel with the ink tank 2.

In FIG. 24, the ink pump 10 is driven by an independent motor 49 and is separately disposed in parallel with the ink tank 2. Thus ink is sucked into the ink suction pipe 44 from the bottom portion of the ink tank 2 to be discharged through an ink feed pipe 11 and to be fed to the ink feed blade 12.

The ink suction pipe 44 and ink feed pipe 11 for transferring the ink are both long pipes.

In the case where a color printing is made by the offset rotary press having an ink feeder as so constructed, a different color of ink is sometimes applied to each sheet (page) of paper that is to be printed and disposed in the widthwise direction of the blanket cylinder 46. For this purpose, attempts are being made to have the ink feeder sectioned in the cross machine direction so that a different color of ink can be fed to each section in the widthwise direction of the blanket cylinder 46 for printing each sheet of paper.

Furthermore, with respect to such an ink pump system of an ink feeder as used in a relief printing, there is disclosed an ink feeder driven for each sheet of paper by way of mechanical drive or motor drive, as seen in the U.S. Pat. No. 2,731,914 "Inking mechanism for printing machines" or the U.S. Pat. No. 3,366,051 "Inking mechanism for printing machines".

FIG. 26 is a detailed cross sectional view of one example of a prior art ink feeder used in an offset rotary press having a keyless ink feeding system of which the entire structure is shown in FIG. 24.

As shown in FIGS. 24 and 26, ink 2*a* is fed onto the ink fountain roller 1 which is driven by a speed control motor (not shown) to rotate at a slightly lower speed than that of the main body of the printing machine. The ink fountain roller 1 is adjusted to a predetermined film thickness via a gap at a tip end of the ink feed blade 12 portion. The ink 2*a* is fed through a nip portion formed between the ink fountain roller 1 and the ink transfer roller 3, which is driven to rotate at a speed of the main body of the printing machine. The ink 2*a* is fed downstream to the ink transfer roller 3, the ink roller group 4, and further to the printing plate 6 via the form roller 5.

In case of an offset printing generally, the printing plate 6 is also fed with damping water from the damping device 29.

The ink 2*a,* transferred in a constant quantity in the cross machine direction, is further fed from the printing plate 6, attached around the plate cylinder 45, onto the blanket cylinder 46 so that a printing is made on a paper which is running in contact with the blanket cylinder 46. Thus, at a portion where no printing is made, the ink 2*a* is not consumed and the ink film thickness does not become thinner.

In the middle of the ink roller group is a doctor roller 7. The ink 2*a* is scraped by a scraping doctor 8 which abuts the doctor roller 7. Therefore, the ink 2*a* is consumed throughout in the cross machine direction so that the ink 2*a,* fed uniformly in the cross machine direction, is consumed in a good balance.

In keyless inking systems in which ink is fed without using an ink quantity regulating mechanism divided into small sections in the cross machine direction, it is necessary to use ink 2*a* of as high a consistency as possible to obtain high quality printed matter.

In the prior art ink feeder 100, a vane wheel 9, fitted with a spiral plate around an outer circumference of a shaft 31, is provided at a bottom portion of an ink tank 2. The vane wheel 9 is for agitating the ink 2*a* and for assisting movement of the ink 2*a* toward a suction port of the ink pump 10. The vane wheel 9, positioned within the ink tank 10, is rotated by a drive motor (not shown).

The ink 2*a* is fed from the ink pump 10 to an ink feed nozzle 511 via an ink feed pipe 11 and then is transferred to an ink feed blade 12 portion following the rotation of an ink fountain roller 1.

For a color printing, etc., it is necessary to change the color of the ink 2*a* for each sheet of paper in the cross machine direction. To accomplish this, the ink feeder 100 is sectioned into plural sets (2 to 4 sets, for example) in the cross machine direction so that the ink 2*a* of a different color is fed for each sheet of paper.

It is to be noted that while a printing is being done, a gap between the ink feed blade 12 and a surface of the ink fountain roller 1 is kept at a constant, predetermined distance. However, the ink feed blade 12 of a keyless ink feeder for a high consistency fluid has not been sectioned for each sheet of paper. It has been formed in one integral unit in the axial direction of the ink fountain roller 1.

In FIG. 26, ink 2*a* is fed from an ink tank 2 into an ink feed pipe 11 by an ink pump 10 via a pipe coupling 333 and then is injected onto the surface of the ink fountain roller 1 from an ink feed nozzle 511. The ink 2*a* is then transferred rotationally on the ink fountain roller 1 in the direction of the arrow in FIG. 26. The ink 2*a* is regulated to a constant film thickness by an ink feed blade 12 so that the ink 2*a* can be further transmitted onto an ink transfer roller 3 through a nip portion.

Residual ink on the surface of the ink fountain roller 1 after the ink is so transmitted is transferred rotationally to be scraped by a scraper 334 fitted right below the ink feed nozzle 511. The surplus ink, scraped by the scraper 334 and the ink feed blade 12, falls down to be recovered in the ink tank 2.

In the ink feeder 100, the ink feed nozzle 511 and the ink feed blade 12, fitted to a support member 151, are both fixed to a frame. As shown in FIG. 26, the support member 151 and the ink feed blade 12 can be moved rotationally around a fulcrum shaft 329 to a state of chain line when a color change of ink 2*a* or cleaning of the ink feed blade 12 is to be done for maintenance services, etc.

When a color change of ink 2*a* is to be done, the pipe coupling 333, positioned midway through the ink feed pipe 11, is first uncoupled so that an ink tank 2 of a next order is replaced. The pipe coupling 333 is then coupled, and a drive source coupling 13, mounted to the printing machine side, and a driven coupling 14 of the ink pump 10 side are coupled. The ink pump 10 is driven to feed new ink, which pushes out old ink so that the ink 2*a* is replaced. Contaminated mixture of ink and wash liquid is recovered in a separate recovery tank (not shown), and after replacement of the ink is completed, the next printing is started.

FIGS. 27 and 28 show a schematic structure of an ink scraping doctor portion in an offset rotary press. In the figures, numeral 3 designates an ink transfer roller, numeral 7 designates a doctor roller, numeral 8 designates a scraping doctor abutting an outer circumference of the doctor roller 7 and numeral 218 designates a scraping doctor support device for supporting the scraping doctor 8.

In the offset rotary press shown in FIGS. 24 to 28, ink 2*a,* injected onto an ink fountain roller 1 which is driven by a speed control motor (not shown) to rotate at a slightly lower speed than that of the main body of the printing machine, is regulated to a predetermined film thickness via a gap at a tip of an ink feed blade 12 portion. Then, the ink 2*a* is fed through a nip portion formed between the ink feed blade 12 and an ink transfer roller 3 which is driven to rotate at a same speed as that of the main body of the printing machine. The ink 2*a* is fed downstream to the ink transfer roller 3 and to an inking roller group 4 for receiving the ink 2*a*. The ink 2*a* is further fed to a printing plate 6 via a form roller 5.

It is to be noted that a residual ink on a surface of the ink fountain roller 1 is transferred rotationally to be scraped by a scraper 334 fitted right below an ink feed nozzle 511. The residual ink scraped by the scraper 334 and the ink feed blade 12 falls down to be recovered in an ink tank 2.

In the offset press generally, damping water is fed onto the printing plate 6 from a damping device. The ink 2*a,* transferred in a uniform quantity in the cross machine direction, is further fed from the printing plate 6, attached around the plate cylinder 45, onto a blanket cylinder 46 so that a printing is made on a paper which is running in contact with the blanket cylinder 46. Thus, at a portion where no printing is made, the ink 2*a* is not consumed and the ink film thickness does not become thinner.

As a method for stabilizing such an irregular film thickness of ink 2*a,* a method is provided wherein the ink 2*a* is scraped by a scraping doctor 8 abutting a doctor roller 7 positioned in the middle of an inking roller group so that the ink 2*a* is recovered throughout in the cross machine direction. Even if the ink is fed uniformly in the cross machine direction, the ink is consumed in a good balance.

While a color printing is made, in which different colors are arranged in the cross machine direction, the ink feeder 100 is constructed so that the roller is sectioned in a plural number (2 to 4, for example) of widthwise sections, and ink 2*a* of a different color is fed for each sheet of paper. It is to be noted that the gap between the ink feed blade 12 and the surface of the ink fountain roller 1 is set to a predetermined distance while the printing is being done.

On the other hand, as shown in FIGS. 27 and 28, since the scraping doctor 8 is formed as one unit extending throughout in the axial direction of the doctor roller 7, it functions well when the ink for each sheet of paper is the same in the widthwise direction. However, if the ink 2*a* is different for each sheet in the widthwise direction of the roller, adjacent ink of different colors is mixed and collected in a contaminated state.

So, in the ink feeder shown in FIGS. 24–26, and in the ink scraping device shown in FIGS. 27 and 28, there are problems to be solved as follows:

(1) In the prior art ink feeder shown in FIGS. 24 and 25:

In this kind of ink feeder, the vane wheel 9 disposed in the ink tank 2 and the motor shaft of the ink pump 10 are positioned separately from and parallel with each other, and the ink tank 2 and the ink pump 10 are apart from each other. Therefore, the ink suction pipe 44 for sucking ink from the ink tank 2 to the ink pump 10, and the ink feed pipe 11 for feeding ink from the ink pump 10 to the ink feed blade 12 become long and their structures also become complicated due to the arrangement.

Accordingly, the piping flow resistance becomes larger. Especially in the elongated ink suction pipe 44, which must take in the ink of a high-consistency fluid, a problem of insufficient suction flow is easily caused.

Also, a drive mechanism for the vane wheel 9 for moving the ink to the opening portion of the ink suction pipe 44 in the ink tank 2 is needed. In addition, a drive motor 49, 50 (see FIG. 25) for driving the vane wheel 9 and the ink pump 10, respectively, becomes necessary.

Further, when a color printing is to be made in type of printing machine, there is sometimes a necessity for changing colors of ink for each sheet of paper to be printed in the widthwise direction of the blanket cylinder 46, as mentioned above. But because the ink feed blade 12 is not sectioned in the cross machine direction, a problem is that this color printing cannot be produced.

Also, even in the ink feeder, including the prior art ink feed blade 12, which is sectioned in the cross machine direction so that a color of ink can be changed for each sheet of paper in the cross machine direction, it is necessary to change the ink feeder, including the ink tank 2.

As mentioned above, however, the ink suction pipe 44 and the ink feed pipe 11 are elongated, and the two drive motors 49 and 50 are provided. Thus the weight of the ink feeder when it is removed from the main body of the printing machine becomes heavier and treatment of electric wires becomes necessary. So, a problem is that attachment and detachment of the ink feeder to and from the main body of the printing machine becomes difficult and work time therefor also becomes longer.

(2) In the prior art ink feeder shown in FIG. 26:

Color change of ink is done by work procedures as mentioned above. Thus, for change of ink to a new ink which is neither contaminated nor diluted, not only is considerable time needed, but there is also a considerable quantity of contaminated ink to be abandoned at the initial stage of the ink change. Also, in this kind of ink feeder, the drive source coupling 13 and the driven coupling 14 must be connected only after they are set to a predetermined engagement position. Thus, if an initial setting for an ink change is neglected, a problem is that connection of the couplings becomes impossible.

Further, since an ink feed blade 12 formed in one unit throughout in the widthwise direction of the ink fountain roller 1, is provided, the inks of adjacent positions in the cross machine direction may mix with each other. This may cause the printing quality to be greatly damaged. In addition, the gap control of the ink feed blade 12 in its longitudinal direction is difficult to maintain, and the gap at the tip of the ink feed blade 12 varies in the widthwise direction of the roller due to variation in the fluid pressure for ink feed and the pressure (reaction force) of the ink scraping. Consequently, it becomes difficult to maintain ink feed in a uniform film thickness throughout in the axial direction of the ink fountain roller 1, and a thick and thin irregularity of color of the printed surface occurs.

Also, at the time of attachment and detachment of the ink feeder 100, a problem is that ink 2*a* falls and scatters from the ink feed nozzle 5, the ink feed blade 12 portion, the pipe coupling 333, etc. and contaminates the surroundings of the printing machine. Also, problems are that it takes a considerable time to attach and detach the pipe coupling 333, and that it is less workable and takes time to remove the residual ink on the ink feed nozzle 511, the ink feed blade 12, etc.

(3) In the prior art ink scraper shown in FIGS. 27 and 28:

In the offset press, printing of plural sheets (4 sheets for example) is sometimes done at one time by use of one set of blanket cylinders which each have different colors of ink. In the prior art, as shown in FIGS. 27 and 28, a means to scrape the ink 2*a,* remaining on the surfaces of the inking roller group after printing includes the use of a single scraping doctor 8. This scraping doctor 8 extends the length of the inking rollers in the axial direction so as to abut the doctor roller 7. For this reason, a problem is that an adjacent color of ink may mix with other colors on the printing plate side so as to cause a dull color, and the aesthetic quality of the printing is greatly damaged.

Although a means for storing the scraped ink in order not to cause such a dull color has been provided, because all of the scraped ink is stored in such a way, there is a need to either enlarge the ink tank, replace the ink frequently, or to abandon it.

SUMMARY OF THE INVENTION

In view of the problems in the prior art as mentioned above, a first object of the present invention is to provide an ink feeder of a printing machine to solve the mentioned problems of the prior art ink tank unit or ink feed blade unit. The ink feeder allows for a high consistency ink to be used, allows an ink tank unit to be decreased in weight, provides that attachment and detachment thereof can be facilitated, and provides an ink feed blade that can be sectioned for each sheet of paper to be printed so that a high quality printing can be done.

A second object of the present invention is to provide an ink feeder of a printing machine which is able to facilitate the disposal and cleaning of residual ink accompanying an ink change. Also, the object is to facilitate the attaching and detaching of the ink feeder and to prevent contamination of the surroundings.

A third object of the present invention is to provide an ink feeder of a printing machine for making a printing of plural colors in a widthwise direction of paper. This ink feeder is able to prevent a dull color due to mixing of different colors so as to enhance the quality of printed matter and to improve the efficiency of an ink change work.

In order to attain these objects, the present invention has the following features of construction:

[1] A first invention is constructed as follows:

(a) An ink tank divided into a plural number of sections in the widthwise direction of an ink fountain roller is provided. The ink tank stores ink to be fed to the ink fountain roller, receives surplus ink scraped by a scraping doctor for scraping ink at a film thickness variation portion in a roller group, and receives damping water fed to prevent ink which has been transferred onto a printing plate from sticking and which falls down alone or together with the ink.

(b) A vane wheel, mounted at a bottom portion of each ink tank, is provided for agitating and mixing the ink and the damping water separated from the ink. The vane wheel also moves the agitated ink toward a suction port portion disposed in the ink tank.

(c) An ink pump for each ink-tank, driven together with the vane wheel, is provided for directly sucking the ink collected at the suction port portion of each ink tank and discharging the ink at an elevated pressure. This pump is able to transfer the ink despite the consistency of the ink. It is to be noted that the ink pump is preferably fitted directly to the ink tank so that the suction port of the ink pump and the suction port provided in the ink tank adjoin, and no ink suction pipe between both suction ports is needed.

(d) An ink feed pipe for each ink pump is provided for transferring the ink discharged from each ink pump onto a surface of the ink fountain roller via an ink feed hole provided in the vicinity of an ink feed blade. It is to be noted that the ink feed pipe is preferably straight and short in length in order to reduce as much as possible the fluid flow resistance of the ink passing through within the ink feed pipe.

(e) An ink feed blade is provided for feeding the ink supplied from each ink feed pipe via the ink feed hole onto the surface of the ink fountain roller. The ink fountain roller rotates at a lower speed so that the ink is fed at a constant rate in the widthwise direction of the ink fountain roller. The ink feed blade is disposed along the outer circumferential surface of the ink fountain roller sectioned in an axial direction of the ink fountain roller. It is to be noted that the ink feed blade is preferably positioned right above the ink tank so that the ink fed below the ink feed blade from the ink pump may be supplied through a short ink feed pipe so as to stick on the ink fountain roller.

(f) A coupling, directly connected to the vane wheel and the ink pump, is provided for transmitting a drive force transmitted from a drive source, such as a motor etc., via a chain, an endless belt, a drive shaft, etc. to drive the vane wheel and the ink pump.

It is to be noted that the ink tank, vane wheel, ink pump, ink feed pipe, ink feed blade and coupling, respectively, are provided in a plural number in the widthwise direction of the ink fountain roller.

According to the first invention, the following functions and effects are obtained:

(i) By the agitation of the vane wheel, the damping water separated from the ink is finely mixed into the ink, and the high consistency ink is made to move easily toward the ink pump suction port.

Accordingly, a higher consistency ink can be used, and by causing the damping water to be mixed into the ink, no discharge of the contaminated water to the outside of the ink feeder occurs.

(ii) The ink pump suction port is fitted so as to connect directly to the ink tank suction port and the discharge pipe is made in a simple form with a shortened length. Thus, the fluid resistance of the ink is small and even if a higher consistency ink is used, no shortcoming such as insufficient suction occurs.

While the suction side of the ink pump may receive insufficient suction due to resistance as the consistency of the ink increases, no suction piping is provided. Therefore, the resistance is small, and the negative influence caused by the high consistency fluid is minimized.

(iii) The vane wheel and the ink pump are directly connected to each other, and the ink pump is directly fitted to the ink tank. Thus there is no idle portion of the piping system and the drive system, and the ink tank unit which must be moved at the time of color change can be lowered in weight.

[2] A second invention, in addition to the first invention, includes ink feed blades provided in a plural number in the widthwise direction of the ink fountain roller for feeding ink at a constant rate from the ink feed pipe via the ink feed hole onto the surface of the ink fountain roller. A gap is provided between the ink feed blades and the outer circumferential surface of the ink fountain roller. This gap is adjustable to a distance by which ink can be fed in such a rate as to enable a high quality printing.

According to the second invention, the consistency of the ink can be adjusted for each of the ink feed blades which feed the ink for each of the sheets passing through the blanket cylinders in the cross machine direction. Therefore, in addition to an entire consistency adjustment in the cross machine direction by a rotational speed adjustment of the ink fountain roller, consistency of ink becomes adjustable for each of the sheets and a printing of higher grade becomes possible.

[3] A third invention, in addition to the first and/or the second invention, is that the ink feed blade is constructed in one integrated unit so as to constitute an ink feed blade unit together with a positioning guide, a fixing and releasing device and an ink feed hole. Therefore, the ink feed blade unit is positioned to be fitted detachably in an upward and downward direction, a frontward and rearward direction, or a rightward and leftward direction relative to the outer surface of the ink fountain roller. The ink feed blade can also be disposed at a right position to feed an accurate quantity of ink to the ink fountain roller.

According to the third invention, positioning of the ink feed blade relative to the ink fountain roller can be done accurately, ink feeding to the ink fountain roller is done correctly and a high grade printing becomes possible. Also, attachment and detachment as well as positioning of the ink feed blade at the time of color change can be done accurately and easily.

[4] A fourth invention, in addition to the third invention, is that a refresh doctor is provided upstream of the ink feed blade for scraping ink sticking on the ink fountain roller prior to the feeding of ink from the ink feed blade in order to improve the sticking ability of ink relative to the ink fountain roller. Also, an ink feed hole for feeding ink to the ink feed blade is provided, and an opening for removing surplus ink on the ink fountain roller from the surface thereof and for causing it to flow into the ink tank is also provided. Both the ink feed hole and opening are positioned between the ink feed blade (positioned at a short distance from the surface of the ink fountain roller) and the refresh doctor.

According to the fourth invention, the sticking ability of newly fed ink to the ink fountain roller is enhanced, the water mixing rate in the ink is stabilized, and the ink film thickness on the outer circumferential surface of the ink fountain roller can be determined quantitatively. Thus, printing quality can be stabilized and a high grade print becomes possible.

[5] A fifth invention, in addition to the first invention, is that a damping water emulsifying device is provided for mixing and emulsifying a damping water fed to the printing plate and which flows into the ink tank together with the ink transmitted via surfaces of the inking roller group etc. or scraped down. This device is positioned in the middle of the ink feed pipe which feeds the ink from the ink tank via the ink pump to the ink feed hole of the ink feed blade unit.

According to the fifth invention, water separated from the ink is emulsified to be homogenized, which prevents the accumulation of separated water. Consequently, irregularity of the printing quality due to inking irregularity caused by insufficient ink transfer or irregular ink transfer can be prevented, a high quality printing can be done, and discharge of contaminated water outside of the ink feeder can be prevented.

[6] A sixth invention, in addition to the first invention, is that the ink tank, vane wheel, ink pump and ink feed pipe are provided in one integrated unit so as to constitute an ink tank unit. A positioning guide for positioning the ink tank unit in an upward and downward direction, a rightward and leftward direction and a frontward and rearward direction, and a fixing and releasing device for attaching and detaching the ink tank unit are provided in each ink tank unit. Disconnection of the coupling for driving the vane wheel and ink pump and disconnecting the ink feed pipe from the ink feed hole of the ink feed blade unit are done by moving the ink tank unit in the direction to allow attachment and detachment thereof.

According to the sixth invention, the ink tank, vane wheel, ink pump and ink feed pipe are provided in one integrated unit of the ink tank unit. At the time the ink color is changed, the ink tank unit is guided in the upward and downward direction and the rightward and leftward direction by the positioning guide which is fitted detachably at a predetermined position of the main body of the printing machine. At this time, the detachment of the ink feed pipe and the ink feed hole is done together by attaching and detaching the ink tank unit. Therefore, attachment and detachment and positioning of the devices becomes remarkably eased.

Also, since there is no motor for driving the ink tank and vane wheel attached to the ink tank unit (which is a carryable object at the time of color change), the carryable object is lowered in weight and no wiring disconnection is needed, so that carrying the ink tank unit becomes easier.

[7] A seventh invention, in addition to the first or sixth invention, is that the said coupling for transmitting a drive force consists of a driven coupling fixed to the drive shaft of the vane wheel and ink pump, and a drive source coupling supported on a printing machine side so that it is detachable relative to the driven coupling automatically by moving the ink tank unit in the direction of attachment and detachment thereof. The drive source coupling is connected to a single motor via a toothed endless belt or a chain for transmitting a drive force from the motor to all the ink pumps and vane wheels at one time.

According to the seventh invention, attachment and detachment of the ink tank unit relative to the main body of the printing machine and connection and disconnection of the ink tank relative to the drive motor for the ink pump and vane wheel are done via the driven coupling and the drive source coupling. Therefore, the attachment and detachment of the ink tank unit relative to the main body of the printing machine becomes easier and quicker.

Also, since no motor is attached to the ink tank, the ink tank can be lower in weight and no disturbance of wiring is needed during any attachment and detachment work, so that carrying becomes easier. Further, there is no need to provide a motor for each of the ink pumps and vane wheels because a single motor is sufficient, so the ink feeder can be made less expensive.

[8] An eighth invention, in addition to the first or sixth invention, is that the coupling includes a driven toothed gear fixed to the drive shaft of the vane wheel and ink pump, and a drive toothed gear fixed to a drive shaft, which is supported on the printing machine side in the widthwise direction of the ink fountain roller. The drive shaft is connected to a single motor via a sprocket and a chain for transmitting a drive force of said motor. The drive toothed gear engages the driven toothed gear automatically when the ink tank unit is moved in the direction of attachment and detachment thereof. The drive toothed gear drives the ink pump and vane wheel, which are provided in a plural number in the widthwise direction of the ink fountain roller.

According to the eighth invention, the drive force transmitted from the motor to the ink pump and vane wheel can be increased.

Also, space in which the drive force is transmitted from the motor to the ink pump and vane wheel, especially space in the height direction, can be made narrower. Therefore, the present invention is favorably applicable to a case where a height restriction on the ink tank is severe and a wider ink tank is required.

[9] In a ninth invention, an ink feeder for a printing machine has plural sets of ink feeders arrayed in the cross machine direction. The ink feeder is constructed so that at least an ink tank; an ink pump; an ink feed nozzle for injecting ink to a surface of an ink fountain roller; an ink feed pipe for connecting the ink tank and the ink feed nozzle; and an ink feed blade mechanism which includes an ink feed blade for adjusting the thickness of the ink on the ink fountain roller and a supporting member for the ink feed blade are constructed in one integrated unit, and the unit is made attachable and detachable relative to a main body of the printing machine.

According to the ninth invention, the ink tank, ink pump, ink feed pipe, ink feed nozzle and ink feed blade mechanism, all of which constitute the ink feeder, are constructed in one integrated unit so as to be detachable relative to the main body of the printing machine. Therefore, mixing of adjacent ink is prevented, and attachment and detachment of the ink feed portion can be done in a short time without contaminating the surroundings of the ink feed portion. Consequently, color change work and cleaning work can be done easily.

The ink tank is provided preferably at a position below the ink feed nozzle and the ink feed blade mechanism so that surplus ink is all recovered below in the ink tank and a greater ability to prevent surrounding contamination can be achieved.

[10] A tenth invention, in addition to the ninth invention, is that the ink feed blade mechanism is separated from the unit so as to be attachable and detachable relative to either the unit or the main body of the printing machine.

According to the tenth invention, the ink feed blade mechanism which cleans residual ink relatively easily is separated from the unit. The printing machine can then be made compact in size and lowered in weight, and cleaning work thereof becomes easier.

[11] An eleventh invention, in addition to the ninth or tenth invention, is that a driven coupling connected to the ink pump and a drive source coupling fitted to the main body of the printing machine are constructed so as to be coupled automatically when the ink feeder is mounted at a predetermined position.

According to the eleventh invention, if the ink pump side coupling of the driven side is moved to the position of engagement with the coupling of the printing machine side, the couplings of both sides engage each other automatically by the cooperation of the couplings. Therefore, when the ink feeder is mounted on the printing machine, there is no need for a prior matching of phases of both couplings, and the ink feeder is efficiently fitted.

[12] In a twelfth invention, an ink scraper is provided for a printing machine having plural colors of ink fed in an axial direction of an inking roller. The ink scraper includes a scraping ink separator having an ink leading plate at its bottom portion for channeling the ink scraped from a surface of a doctor roller by a scraping doctor. The ink separator also has a color mixing prevention wall fixed to each side of the ink leading plate so as to rise perpendicularly therefrom for preventing mixing of adjacent ink. The ink separator is arrayed in an axial direction of a scraping doctor supporting device for supporting said scraping doctor.

According to the twelfth invention, the surplus ink sticking on the outer circumferential surface of the doctor roller is scraped by the scraping doctor and flows into each of the scraped ink separators. The ink remains separated into each color of ink by the color mixing prevention wall on each side of the scraped ink separator.

Also, the scraped ink separator can be made of a thin plate for lower weight. The ink leading plate of said separator is also made so as to form plural faces, so that rigidity can be increased as compared to that of a single face. Further, the color mixing prevention wall of the separator is perpendicularly fixed to the ink leading plate. This increases the rigidity of the separator as well as preventing ink color mixing as mentioned above. Thus, a sufficient rigidity is obtained with lower weight and easier handling.

[13] A thirteenth invention, in addition to the twelfth invention, is that the scraped ink separator is positioned so that a flow-out port for the scraped ink provided at a lower portion of the scraped ink separator is located above the ink tank.

According to the twelfth invention, the separated ink is recovered in the ink tank positioned below the flow-out port of each separator. Thus, the ink can be separated and recovered for each sheet of paper to be printed in different colors. Therefore, mixing of ink is prevented and ink loss is reduced.

[14] A fourteenth invention, in addition to the twelfth or thirteenth invention, is that the ink scraper comprises a clamp device for detachably fitting the scraped ink separator on the scraping doctor supporting device.

According to the fourteenth invention, the attachment and detachment of the scraped ink separator relative to the scraping doctor supporting device is done easily by a lever operation of the clamp device. Consequently, ink color change is done quickly and cleaning of the sticking ink is done easily.

The present invention consists of the first to fourteenth invention and has effects as summarized below:

[1] According to the first to the eighth invention:

(1) An ink feeder which is able to respond to a high consistency ink and is detachable and of a light weight is provided. Since a vane wheel is disposed at a bottom portion of an ink tank, even a high consistency ink can be moved easily to a suction port of the ink tank. Damping water which comes in can be mixed with the ink to be fed again, so no contaminated water to be wasted outside of the ink feeder system is generated.

Further, because the vane wheel and an ink pump are connected to each other directly, ink suction pipe becomes unnecessary, and ink feed pipe to an ink fountain roller becomes minimal in length. Thus, the printing machine becomes compact in size and light in weight, attachment and detachment become easy, ink fluid resistance becomes small, a high consistency ink becomes usable, and a high quality printing can be done.

In addition thereto, because a motor for the ink pump is positioned outside of an ink tank unit, the weight of the motor is not included in the weight of the ink tank unit. Furthermore, because there is no wiring in the ink tank unit, the ink tank unit becomes light in weight and easily detachable.

(2) A gap between an ink feed blade and the ink fountain roller can be adjusted for each ink feed unit arrayed in the cross machine direction. The ink film thickness or density to be printed can be changed for each sheet of paper in the cross machine direction.

That is, in addition to an entire widthwise simultaneous density adjustment by adjusting the speed of the ink fountain roller, a density adjustment for each sheet of paper in the widthwise (cross machine) direction can be done. Despite a keyless inking, a fine ink density adjustment is done, so that a high quality printing becomes possible.

(3) In addition to the vane wheel in the ink tank, a damping water emulsifying device is provided in the ink feed pipe. Therefore, water separated from the ink is mixed again in the ink, and a finely homogenized mixture can be obtained.

Accordingly, an insufficient ink transfer due to separated water can be prevented, density irregularity is reduced and even a high consistency ink is usable for printing. Thus, a high quality printing becomes possible.

Also, water is mixed in the ink so as not to be wasted outside of the inking device system, and contaminated water treatment facilities etc., become unnecessary.

(4) Because there are provided movement guides for positioning in the upward and downward direction, the rightward and leftward direction and the frontward and rearward direction and for attachment and detachment in the frontward and rearward direction, the ink tank unit and the ink feed blade unit, respectively, can easily be attached and detached relative to the main body of the printing machine.

Also, when the ink tank unit and the ink feed blade unit are fitted to each other, the movement is in the same direction as the movement of the ink tank unit. Thus, attachment and detachment of the ink tank unit becomes even easier.

(5) The ink fed from the ink feed pipe sticks on the ink fountain roller after the residual ink on the ink fountain roller is scraped by a refresh doctor. Thus, the quality of the ink fed becomes stabilized and printing quality can be stabilized.

[2] According to the ninth to eleventh invention:

The main portion of the ink feeder is constructed in an integrated unit to be detachable relative to the main body of the printing machine. Therefore, when the ink feeder is attached or detached, mixing of adjacent ink is prevented and contamination of surrounding devices is prevented.

Also, cleaning of the residual ink on the ink feed nozzle and the ink feed blade portion becomes easier, and the efficiency of a color change can be increased.

In addition thereto, because the ink feed blade mechanism in which cleaning of the residual ink is relatively easy is made in a separate unit, the printing machine can be made further compact in size and lowered in weight, cleaning is facilitated and, workability at the time of attachment and detachment of the ink feeder is enhanced.

Further, the coupling on the printing machine side (the motor side or the drive source side) and the coupling on the driven side are coupled automatically by only both couplings being fitted to each other. Thus, there is needed no initial setting of phase matching as has been done in the prior art and the fitting efficiency of the ink feeder is enhanced.

[3] According to the twelfth to the fourteenth invention:

Plural colors of ink are transferred and fed in the axial direction of the ink fountain roller when a printing in plural different colors of ink is applied to plural sheets of paper in the cross machine direction. Even in that case, however, surplus ink of each color can be separated and recovered, and mixing of adjacent different colors of ink causing contamination of the ink can be prevented. Therefore, enhanced printing quality and maintenance become possible, and the scraped ink can be recovered in an ink tank corresponding to each color. Furthermore, there is less loss of ink and the ink can be reused efficiently.

In addition thereto, attachment and detachment of the scraped ink separator are done easily. Thus, ink color change for each sheet of paper in the cross machine direction can be done quickly, and shortening of set-up time becomes possible.

DESCRIPTIONS OF THE PREFERRED EMBODIMENTS

A description is now provided for embodiments of an ink feeder and an ink scraper of a printing machine according to the present invention with reference to accompanying figures.

It is to be noted that, for simplicity purposes, description of the present embodiment is made only with respect to a portion of the widthwise direction, or cross machine direction, along which an ink tank assembly 21 and an ink feed blade assembly 20 (both of wider width) are arranged. This is true except where a mechanism for printing of different colors of ink for sheets in the widthwise direction is described.

Figure 4:
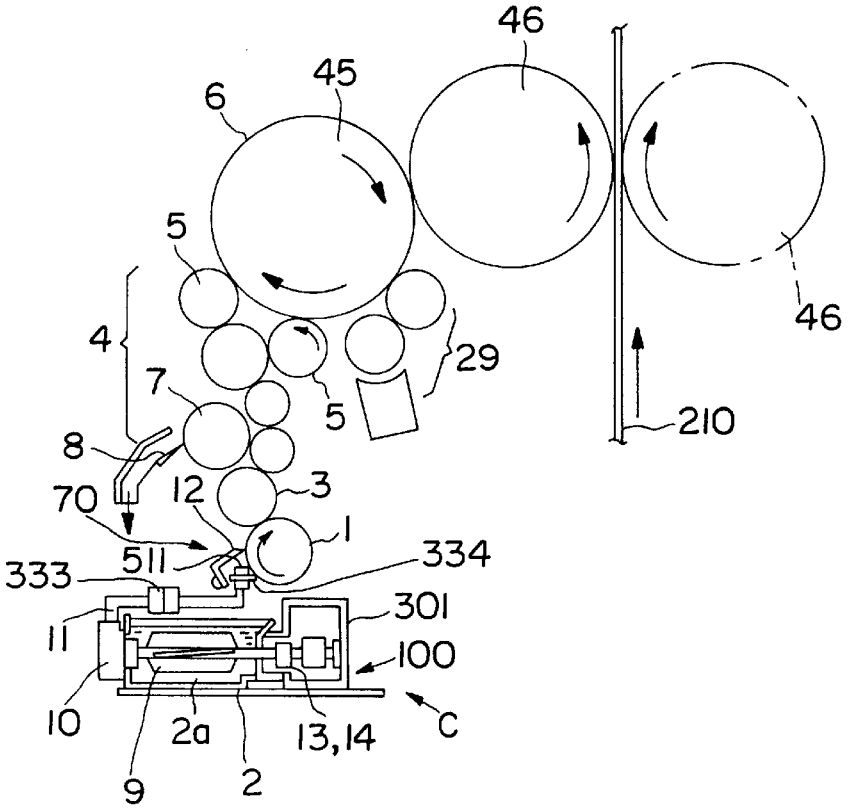
FIG. 4 is a schematic cross sectional view of one color printing part of a printing machine to which the first embodiment of FIG. 1 is applied.
Figure 5:
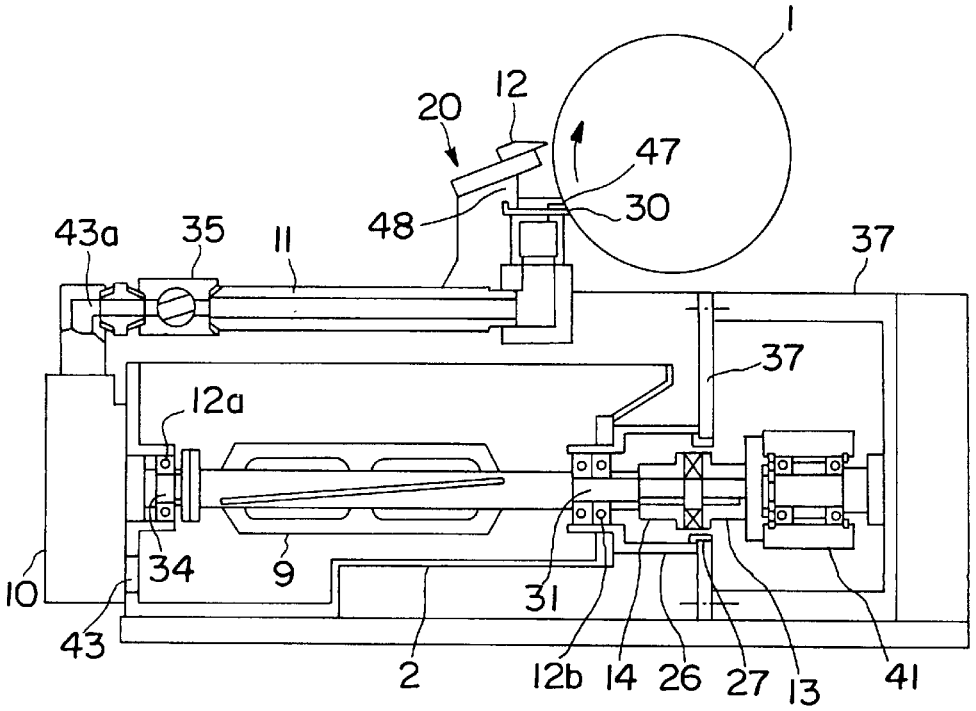
FIG. 5 is a detailed cross sectional view of C portion of FIG. 4.

As shown in FIGS. 4 and 5, ink stored in an ink tank 2 is sucked into a suction port of an ink pump 10 from a suction port 43 provided in a side wall of the ink tank 2. The ink is elevated in pressure so as to be fed through an ink feed pipe 11 and injected through an ink feed hole 47 so it will stick on an outer circumferential surface of an ink fountain roller 1.

The ink fed on the ink fountain roller 1 is adjusted to a constant film thickness corresponding to a gap formed between an ink feed blade 12 and the ink fountain roller 1 and is fed onto an ink transfer roller 3.

Figure 6:
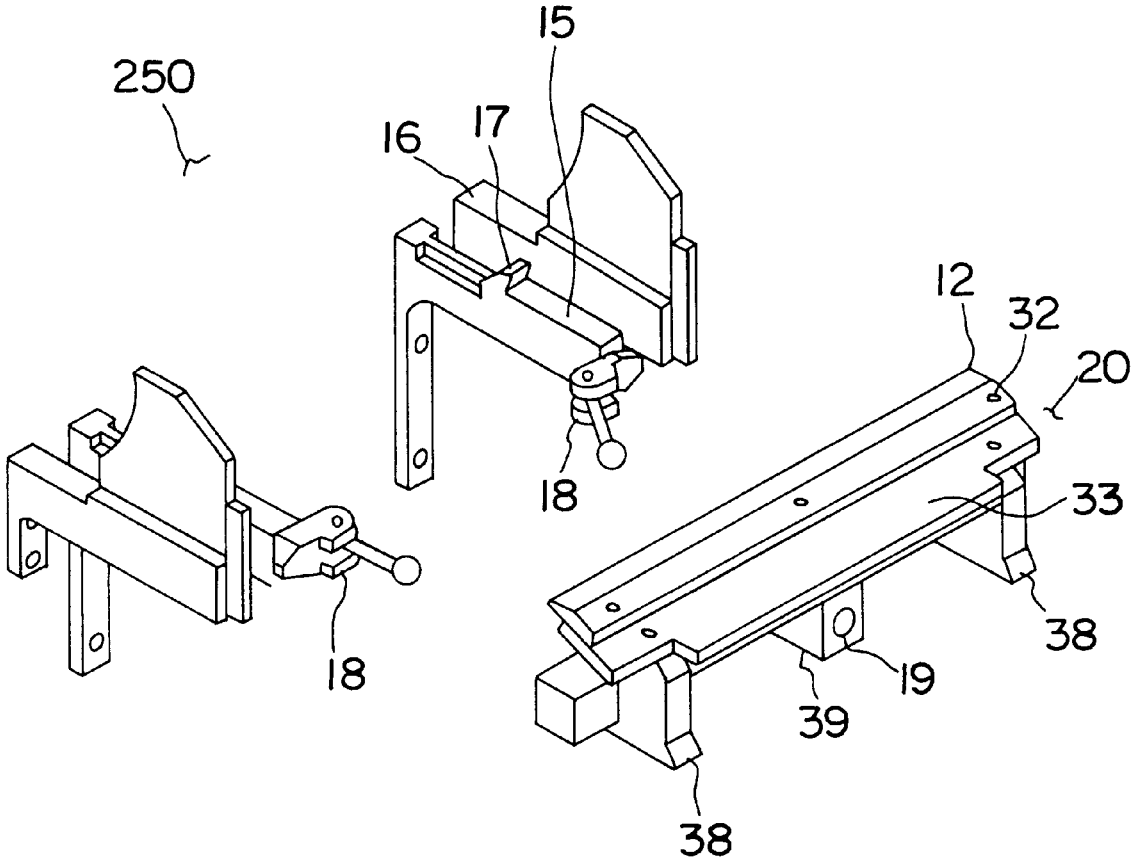
FIG. 6 is an exploded view for explaining attachment and detachment of an ink feed blade unit.

As shown in FIG. 6, the ink feed blade 12 is fitted to a fitting plate 33 by a bolt 32. If the bolt 32 is loosened, the ink feed blade 12 is movable in a space formed between the bolthole and the bolt 32 so that a gap between a tip of the ink feed blade 12 and the outer circumferential surface of the ink fountain roller 1 can be set to a predetermined length.

Ink is fed through the gap as so set and is adjusted to a film thickness, while sticking uniformly in the widthwise direction on the outer circumferential surface of the ink fountain roller 1.

The ink fountain roller 1 is driven by a single speed control motor (not shown) to rotate at a lower speed than that of the printing machine so as to follow the speed of the printing machine. The ink fountain roller 1 is also controllable at a relative speed and, by changing this relative speed, ink density (thickness) in the entire widthwise direction can be adjusted.

In FIG. 4, ink fed from the ink fountain roller 1 is transmitted to the ink transfer roller 3. The ink is then transferred from the ink transfer roller 3 via the inking roller group 4 and via a form roller 5 in the inking roller group 4, to a printing plate 6 which is fitted around an outer circumferential surface of a plate cylinder 45 so as to form a printing face. Then, the ink is transferred via a blanket cylinder 46 onto a paper running between the blanket cylinder 46 and another blanket cylinder 46 opposed thereto so that a printing is applied to the paper.

The ink sticks on the paper to be consumed corresponding to pictures and letters to be printed. Thus, as mentioned above, the ink fed in a constant film thickness in the widthwise direction via the ink fountain roller 1 and the inking roller group 4 has a differential film thickness generated in the widthwise direction of the inking roller group 4. In other words, at a position of the printing plate 6 having no picture nor letter in the widthwise direction, no ink is transmitted from the form roller 5 but ink is fed from the ink transfer roller 3. Therefore, a stagnation of ink on the inking roller group 4 occurs so that a differential film thickness of ink in the widthwise direction is generated.

This differential thickness of ink generated in the widthwise direction is scraped by a doctor 8, abutting a doctor roller 7. This doctor 8 is provided in the inking roller group 4 so that the film thickness of ink is maintained uniform in the widthwise direction of the inking roller group 4. Consequently, consumption of ink on the printing plate 6 and the quantity of ink fed from the ink fountain roller 1 are balanced.

Accordingly, the ink can be fed at a constant rate from the ink fountain roller 1 regardless of pictures and letters to be printed.

An apparatus of a system in which a constant and uniform quantity of ink is so fed in the widthwise direction is generally called a keyless ink feeder.

Figure 1:
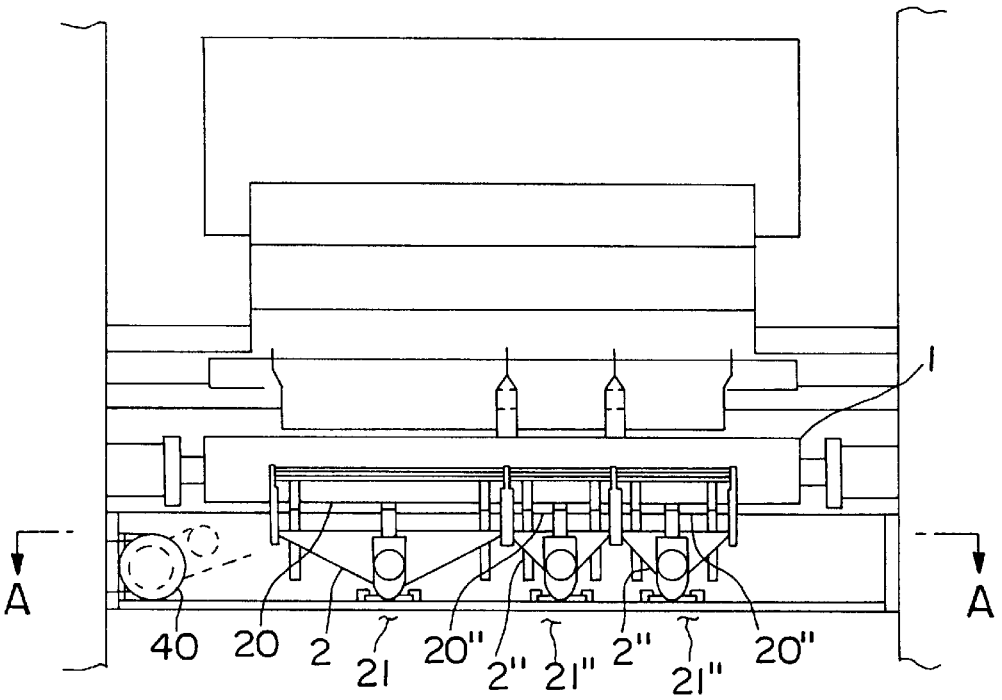
FIG. 1 is a front view showing an ink feeder of a first embodiment according to the present invention.

As shown in FIG. 1, the keyless ink feeder according to the first embodiment has an ink tank assembly 21 and an ink feed blade assembly 20 both of relatively greater width in the widthwise direction, and two ink tank assemblies 21" and two ink feed blade assemblies 20" both of relatively less width in the widthwise direction. The assemblies of less width are applicable to a case where four sheets of paper are to be printed in the widthwise direction of the blanket cylinder 46, and where the color of two sheets passing on the left hand side of the blanket cylinder 46 are different from the color of the two sheets passing on the right hand side. It is also possible to provide four sets, each for one sheet of paper. In other words, four ink tank assemblies 21" and four ink feed blade assemblies 20" all of less width, can be provided so as to be applicable to a case where all the adjacent colors are different from each other.

Also, as shown in FIGS. 4 and 5, the ink scraped by the scraping doctor 8 and the surplus ink not fed onto the ink fountain roller 1 from the ink feed blade 12 falls down from an opening 48 into the ink tank 2.

Further, damping water fed onto the printing plate 6 from a damping device 29 is transmitted to the surfaces of the inking roller group 4 etc., or is mixed in the ink to be scraped by the scraping doctor 8 and enters the ink tank 2.

Figure 2:
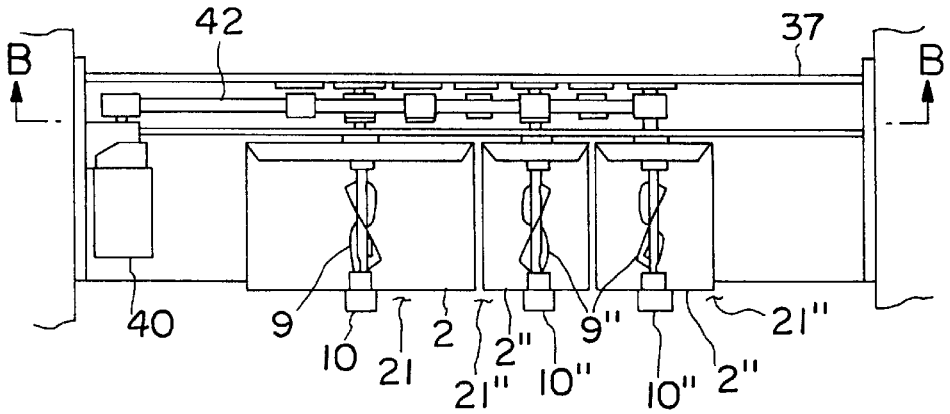
FIG. 2 is a view taken on line A—A of FIG. 1.

As shown in FIGS. 2 and 5, a vane wheel 9 is provided at a lower portion of the ink tank 2. One end portion of a shaft 31 of the vane wheel 9 passes through the ink tank 2. This end portion is supported freely in the rotational direction and fixedly in the axial direction by a bearing box 26 for supporting a bearing 12*b* provided in the side wall of the ink tank 2. At the place where the shaft 31 of the vane wheel 9 passes through, a seal for preventing a leakage of ink is also provided.

At this end portion of the shaft 31 passing through the bearing box 26 and projecting outside of the ink tank 2, a driven coupling 14 is fitted. By a relative movement to an opposing drive source coupling 13 in the axial direction, the bearing box 26 engages a guide 27 so that the driven coupling 14 and the drive source coupling 13 engage each other, and a rotational force from a drive pulley 41 can be transmitted.

In FIG. 5, the other end of the shaft 31 is connected via a flange to a roller drive shaft 34 for driving an ink pump 10 fitted to the side wall of the ink tank 2. Because the ink pump 10 is directly fitted to the side wall of the ink tank 2, a suction port of the ink pump 10 can be directly opened to a suction port 43 opened in the side wall of the ink tank 2. Therefore, such long piping as has so far been needed becomes unnecessary.

A discharge port 43*a* of the ink pump 10 is connected to an end of the ink feed pipe 11 via one bent portion. The ink discharged from the ink pump 10 is fed to the ink feed blade assembly 20 through the ink feed pipe 11. That is, the ink feed pipe 11 which has so far been necessarily elongated can be shortened and straightened.

Also, as shown in FIG. 5, damping water emulsifying device 35 is fitted in the ink feed pipe 11. The damping water emulsifying device 35 may, as shown in FIG. 8, fairly well function by the use of a plate-like element provided in the pipe or even by the use of an ordinary valve or the like.

In FIG. 5, the ink discharged from the ink pump 10 and fed to the ink feed blade assembly 20 via the ink feed pipe 11 is discharged from a refresh doctor 30 onto the outer circumferential surface of the ink fountain roller 1 at the downstream side. The ink so discharged sticks on the outer circumferential surface of the ink fountain roller 1. The ink thickness approximately corresponds to a gap formed between the ink feed blade 12 of the ink feed blade assembly 20 and the outer circumferential surface of the ink fountain roller 1. Any surplus ink falls down into the ink tank 2 from an opening 48 which opens below the ink feed blade 12.

The ink feed blade 12 is constructed, as shown in FIG. 6, so as to be fixed to a fitting plate 33 by a bolt 32. When the bolt 32 is loosened and moved within an oblong shape hole provided in the fitting plate 33, the gap between the outer circumferential surface of the ink fountain roller 1 and a tip of the ink feed blade 12 can be adjusted. Thus, this gap is so adjusted and fixed by the bolt 32.

Figures 7A, 7B:
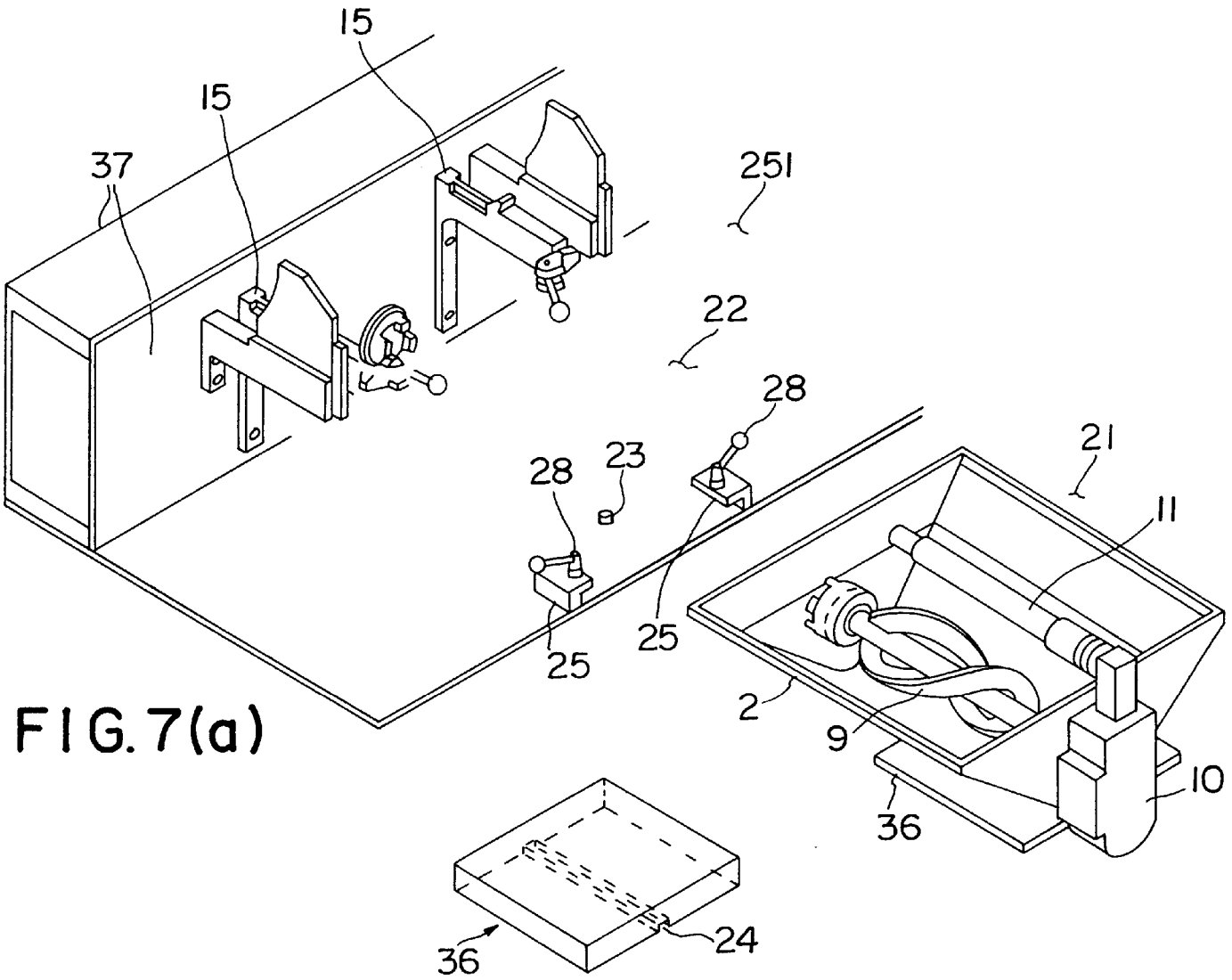
FIG. 7 is an exploded view for explaining attachment and detachment of an ink tank unit, wherein (A) shows the ink tank unit and attachment devices and (B) shows the ink tank unit bed plate.
Figure 8A:
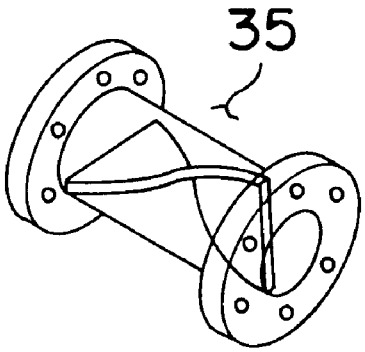
FIG. 8 is a perspective view showing examples of a damping water emulsifying device which is applied to the first embodiment of FIG. 1, wherein (A) is a first example of an emulsifying device, (B) is a second example of an emulsifying device, (C) is a third example of an emulsifying device, and (D) is a fourth example of an emulsifying device.
Figure 8B:
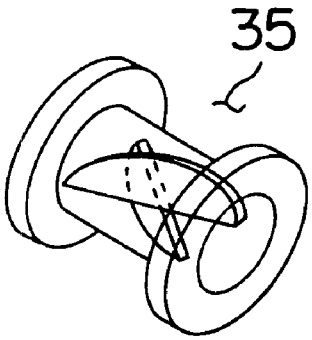
Figure 8C:
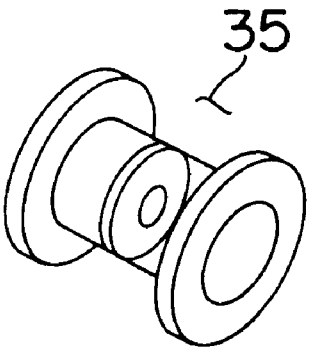
Figure 8D:
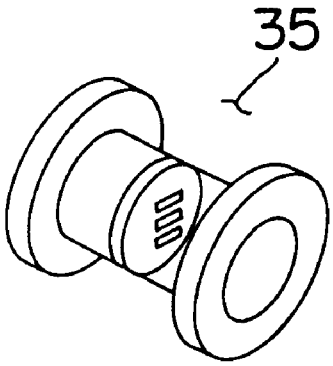

As shown in FIG. 7, an integrated ink tank unit 21 is provided wherein the ink tank assembly having an ink tank 2, an ink pump 10, and a vane wheel 9, and the ink feed pipe 11, etc. are integrated and fitted to a bed plate 36. In order to make the ink tank unit 21 easily detachable with a high accuracy of fitting position, the ink tank unit 21 is made slidable on an ink tank unit positioning guide 251, including a sole plate 22 for guiding an upward and downward direction of the ink tank unit 21. The positioning guide 251 also includes a guide pin 23 fixed on the sole plate 22 for positioning the ink tank unit in the widthwise direction (rightward and leftward direction). A guide groove 24, which engages the guide pin 23, extends in the machine direction (moving direction of the ink tank unit 21 when it is detached) on a back side surface of the bed plate 36 for mounting the ink tank unit 21 on the positioning guide 251.

As shown in FIGS. 5 and 7, if the ink tank unit 21 is to be fitted to the sole plate 22, a distal side portion of the ink tank unit 21 is set to an upper and lower, right and left, front and rear (axial direction of the shaft 31) position in such a way that the bearing box 26 for supporting the bearing 12*b*, which is set concentrically with the drive source coupling 13, engages a guide 27. The guide 27 is fixed to a transverse beam 37, for guiding the ink tank unit 21 in the right and left direction and in the front and rear direction. The distal side portion of the ink tank unit 21 abuts the transverse beam 37 in the front and rear direction.

After the positioning is finished, the ink tank unit 21 is fitted by a detachable lock mechanism 28 which is provided fixedly to a guide plate 25. The guide plate 25 is fitted to the sole plate 22 of the ink tank unit positioning guide 251, and guides the right and left movement of the bed plate 36 and ink tank unit 21.

At this time, the driven coupling 14, shown in FIG. 5, which is a drive inlet portion of the vane wheel 9 and the ink pump 10, is coupled detachably to the drive source coupling 13 in the axial direction, and a drive force can be well transmitted in the coupled state.

It is to be noted that description has been made of the embodiment of the ink tank unit 21 in which the driven coupling 14, the vane wheel 9 and the ink pump 10 are arranged in this order. However, it is also possible to arrange them in an order of the driven coupling 14, the ink pump 10 and the vane wheel 9.

Also to be noted is that a speed changer may be provided between the vane wheel 9 and the ink pump 10, if necessary.

As for detachment of the ink tank unit 21, the detachable lock mechanism 28 is released and then the ink tank unit 21 can be taken out of the sole plate 22, as shown in FIG. 7.

Next, the ink feed blade assembly may be assembled as an integrated ink feed blade unit 20 including, as shown in FIG. 6, the ink feed blade 12, a fitting plate 33, a bracket 38, an ink receiving member 39, etc. The ink feed blade unit is supported on an ink feed blade unit positioning guide 250 such that the bracket 38 is placed on a guide rail 15 of the positioning guide 250. The guide rail 15 is fixed to the transverse beam 37 with respect to the upward and downward direction. A distal end of the bracket 38 abuts a stopper 17 of the guide rail 15 with respect to the frontward and rearward direction. A side face of the bracket 38 abuts a side plate 16 fixed to the transverse beam 37, and a proximal end portion of the bracket 38 is pressed to be locked by the detachable lock mechanism 18.

In FIGS. 6 and 7, ink is fed from the ink feed pipe 11 of the ink tank unit 21 and introduced into an ink feed hole 19 of the ink feed blade unit 20. The ink feed pipe 11 is provided in the same direction as the movement of attachment and detachment of the ink tank unit 21 and, corresponding thereto, the ink feed hole 19 of the ink feed blade unit 20 is also provided in the same direction so as to coincide with the direction of such movement of the ink tank unit 21. This enables easy attachment and detachment to and from the ink feed pipe 11 when the ink tank unit 21 is attached and detached.

Figure 3:
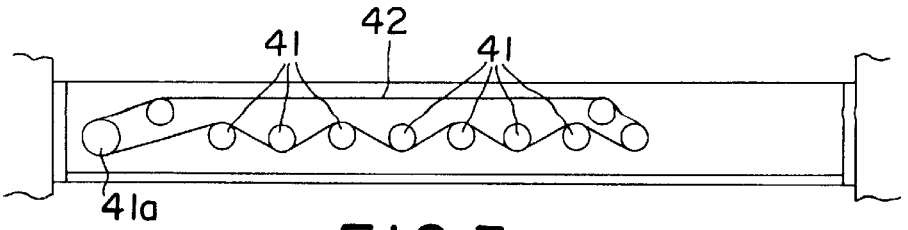
FIG. 3 is a view taken on line B—B of FIG. 2.

Next, as shown in FIGS. 2 and 3, an ink pump drive motor 40 for driving the ink pump 10 and the vane wheel 9 has a sufficient capacity for driving all of the ink tank units 21, 21", 21" disposed in the widthwise direction. The ink pump drive motor 40 is provided in a single unit for driving commonly all the ink tank units shown in FIGS. 2 and 3.

If a printing is made on four sheets of paper in the cross machine direction, a drive pulley or drive sprocket 41 is disposed at a center of each sheet and between each sheet, respectively. A common drive is provided by using a drive pulley or drive sprocket 41*a* fitted to the ink pump drive motor 40 and using a band such as a toothed endless belt or chain 42.

Because the drive pulley or drive sprocket 41 is disposed at the center of each sheet and between each sheet, respectively, a drive force can be obtained at each center in the cross machine direction whether in an ink tank unit 21 for two sheets or in an ink tank unit 21" for one sheet.

Basic functions of the second embodiment are the same as those of the first embodiment as described above. Primarily, different points will be described.

Figure 9:
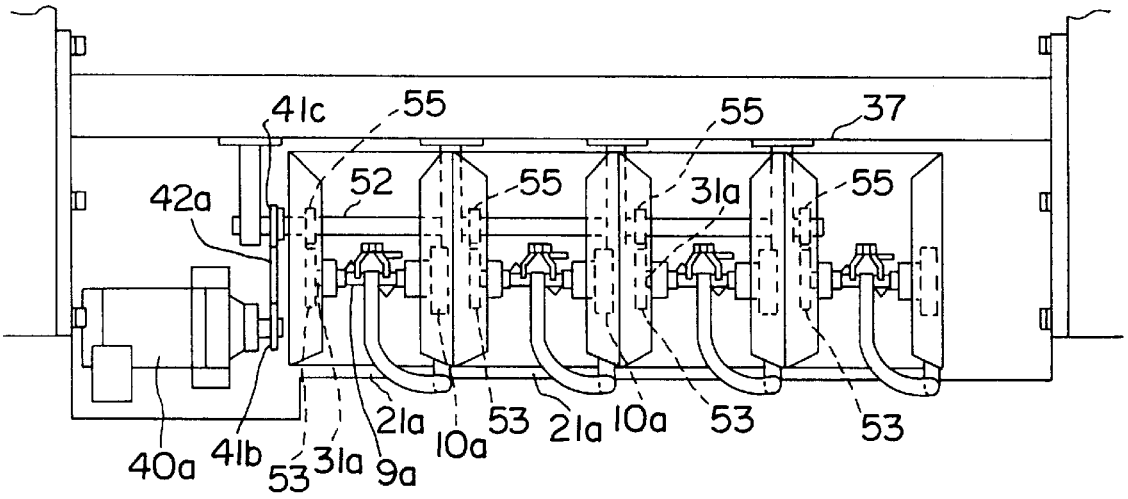
FIG. 9 is a view showing an ink feeder of a second embodiment according to the present invention, wherein there are provided four sets of an ink tank unit for one sheet each and a plan view thereof taken on the same line as A—A of FIG. 1 is shown.
Figure 10:
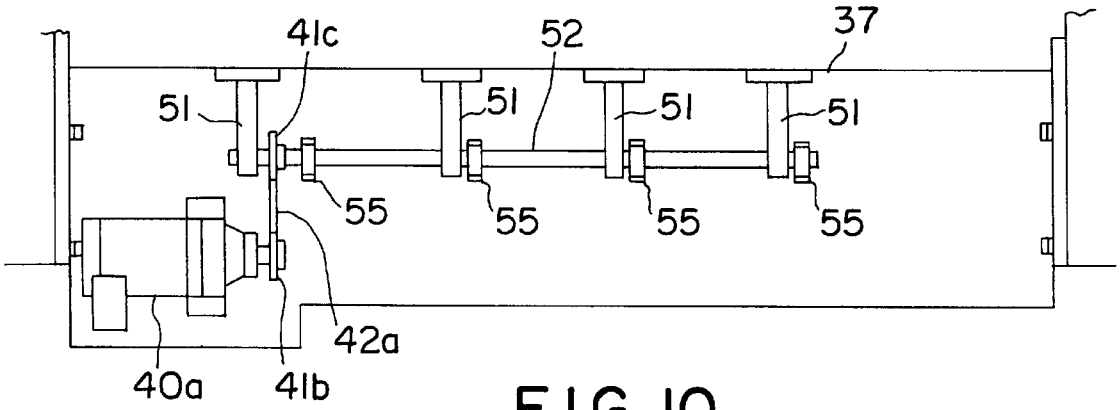
FIG. 10 is a plan view showing an ink pump drive system for the ink feeder of the second embodiment shown in FIG. 9.
Figure 11:
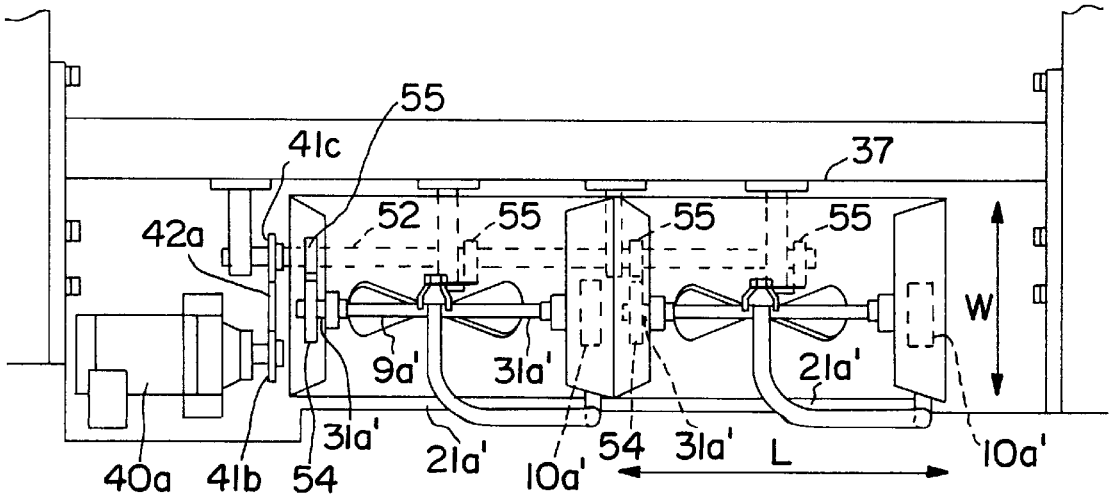
FIG. 11 is a plan view, taken on same line as that of A—A of FIG. 1, showing an ink feeder having two sets of an ink tank unit for two sheets each.

In FIGS. 9 to 11, a vane wheel 9*a*, 9*a'* of the second embodiment and a shaft 31*a*, 31*a'* for connecting an ink pump 10*a*, 10*a'* concentrically with the vane wheel 9*a*, 9*a'* are positioned parallel to the axial direction of the ink fountain roller 1 (see FIG. 1). Likewise, an ink pump drive motor 40*a* for driving the vane wheel 9*a*, 9*a'* and the ink pump 10*a*, 10*a'* is provided with its output shaft also arranged parallel to the ink fountain roller 1.

A bracket 51 is provided which projects from a transverse beam 37 provided on the printing machine side. The bracket 51 projects toward the ink tank unit 21*a*, 21*a'* side and there is provided a secondary drive shaft 52 supported by the bracket 51 so as to extend in the axial direction of the ink fountain roller 1.

In FIGS. 9 to 11, a chain 42*a* is provided between a sprocket 41*b* fitted to the output shaft of the ink pump drive motor 40 for driving the ink pump 10*a*, 10*a'*, etc. A sprocket 41*c* is fitted to an end portion of the secondary drive shaft 52 (see FIG. 10). A drive force for driving the vane wheel 9*a*, 9*a'* and the ink pump 10*a*, 10*a'* is transmitted by the chain 42*a* from the ink pump drive motor 40*a* to the secondary drive shaft 52.

Also, provided to the secondary drive shaft 52 driven by the ink pump drive motor 40*a* are drive toothed gears 55 at such positions as to engage with driven toothed gears 53, 54 fitted to the shaft 31*a*, 31*a'*. These toothed gears drive the vane wheel 9*a*, 9*a'* and the ink pump 10*a*, 10*a'* when the ink tank unit 21*a*, 21*a'* is incorporated in the printing machine.

Since the ink feeder of the second embodiment is constructed as mentioned above, when the ink tank unit 21*a*, 21*a'* is incorporated into an operation position, the driven toothed gear 53, 54 which is fitted to the shaft 31*a*, 31*a'* for driving the vane wheel 9*a*, 9*a'* and the ink pump 10*a*, 10*a'* of the ink tank unit 21*a*, 21*a'* engages with the drive toothed gear 55 fitted to the secondary drive shaft 52. Therefore, the vane wheel 9*a*, 9*a'* and the ink pump 10*a*, 10*a'* become ready to be driven by the ink pump drive motor 40*a*.

According to the second embodiment as described above, the coupling for transmitting the drive force is constructed by toothed gears.

By use of such construction, an advantage is obtained that the ink tank unit can be widened enough when using the ink tank unit 21*a'* for two sheets of paper, as shown by L in FIG. 11.

That is, in the ink tank unit 21 described with respect to FIGS. 1 and 2, there can hardly be obtained a slope of the ink tank 2 for leading the ink at the vane wheel 9 portion, especially when the height direction is limited. Also, there may be a need for providing two sets of the vane wheel 9 for improvement thereof. But in the second embodiment shown in FIGS. 9 to 11, the vane wheel 9*a'* can be elongated in the cross machine direction and the force for moving the flow of the ink in the cross machine direction can be increased. Also, while there are many cases where the length in the frontward and rearward direction, shown by W in FIG. 11, is inevitably made relatively small, the ink tank 2 area according to the present embodiment can easily be made relatively large. Thus, the ink feeder according to the second embodiment is most appropriate for a case where a height restriction is relatively severe and a wider ink tank 2 is needed.

Figure 12:
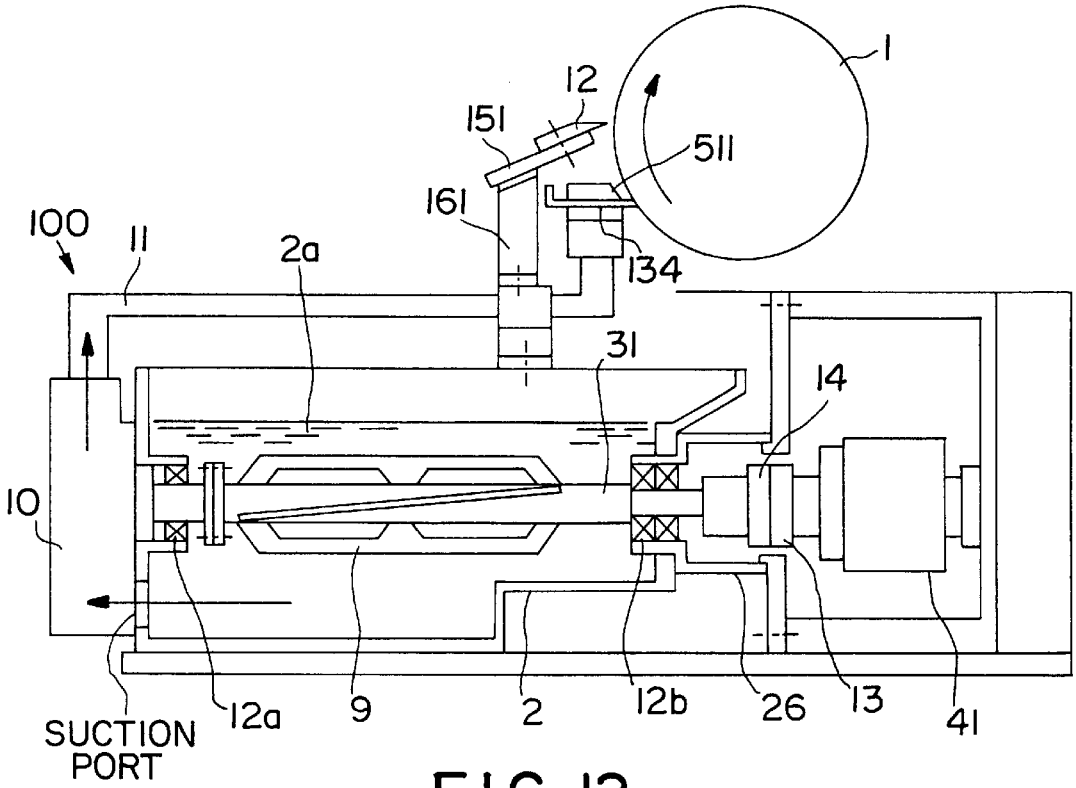
FIG. 12 is a cross sectional view of an ink feeder of a third embodiment according to the present invention.

In FIG. 12, numeral 10 designates an ink pump, numeral 11 designates an ink feed pipe, numeral 511 designates an ink feed nozzle, numeral 1 designates an ink fountain roller and numeral 12 designates an ink feed blade. In the ink feeder shown in FIG. 12, ink 2*a* which fills an ink tank 2 is fed via the ink pump 10 through the ink feed pipe 11 and injected through the ink feed nozzle 511 at a tip of the ink feed pipe 11 onto the ink fountain roller 1. The ink fountain roller 1 is rotated with the ink 2*a* sticking thereon and the ink 2*a* is adjusted to a predetermined film thickness corresponding to a gap between the ink feed blade 12 and the ink fountain roller 1 and is transferred onto an ink transfer roller 3 (see FIG. 4). The ink 2*a* is further transferred sequentially in an inking roller group (see FIG. 4) so that it is used for a printing via a plate cylinder 45 and a blanket cylinder 46.

In an ink feeder of the third embodiment of the present invention, as shown in FIG. 12, the ink feeder 100 is constructed in one integrated unit and includes the ink tank 2, the ink pump 10, the ink feed pipe 11, the ink feed nozzle 511, the ink feed blade 12, etc. The ink tank 2 is positioned below a flow-out and falling-down portion of surplus ink from the ink feed blade 12 portion and the ink feed nozzle 11 portion. The ink feeder 100 as a unit is made detachable relative to the main body of the printing machine.

Figure 17:
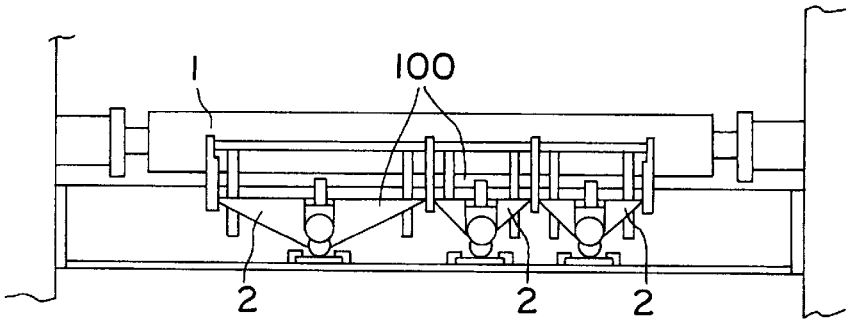
FIG. 17 is a front view showing a fitting mode of the ink feeders of the third and fourth embodiments.

FIG. 17 shows an example in which three sets of ink feeders 100 integrated in one unit, as mentioned above, are arrayed in the printing machine.

In FIG. 12, a vane wheel 9 is disposed at a lower portion of the ink tank 2. One end of a shaft 31 of the vane wheel 9 passes through outside of the ink tank 2 and both ends of the shaft 31 are supported by bearings 12*a* and 12*b*. Thus, movement of the vane wheel 9 in the axial direction is restricted. Also, seals are provided for preventing leakage of ink at the bearings 12*a* and 12*b* portions.

In the same figure, numeral 13 designates a drive source coupling connected to a drive source (not shown). Numeral 14 designates a driven coupling connected to said drive source coupling 13 and numeral 26 designates a bearing box for supporting the bearing 12*b*. The driven coupling 14 is fitted to the end of the shaft 31 and is movable in the axial direction, but non-rotatable via a key, a bolt, etc.

Figure 14A:
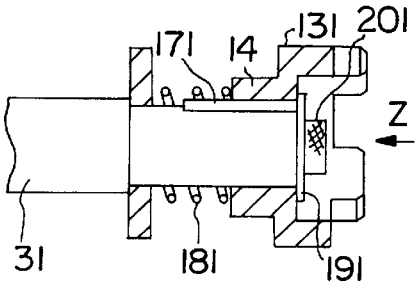
FIG. 14 is a view showing a first example of a coupling portion of the ink feeder of the third embodiment, wherein (A) shows a coupling on the vane wheel side, (B) shows a view taken in arrow Z direction of (A) and (C) shows a coupling on the printing machine side.
Figure 14B:
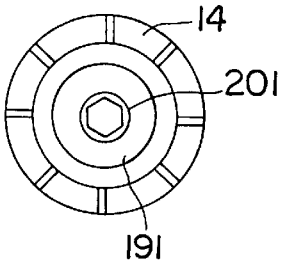
Figure 14C:
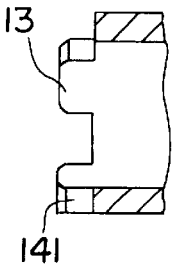
Figure 15A:
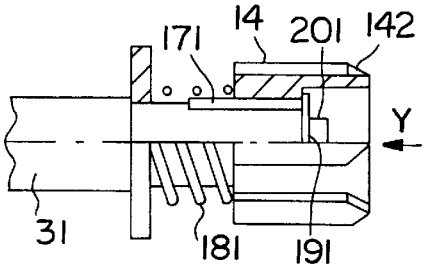
FIG. 15 is a view showing a second example of the coupling portion in the same way as FIG. 14, provided that (B) of FIG. 15 is a view taken in arrow Y direction of (A) of FIG. 15.
Figure 15B:
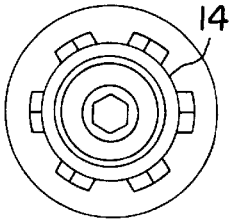
Figure 15C:
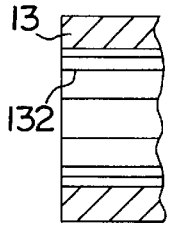
Figure 16A:
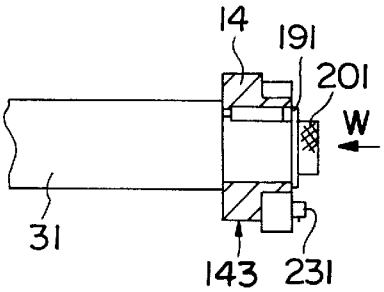
FIG. 16 is a view showing a third example of the coupling portion in the same way as FIG. 14, provided that (B) of FIG. 16 is a view taken in arrow W direction of (A) of FIG. 16.
Figure 16B:
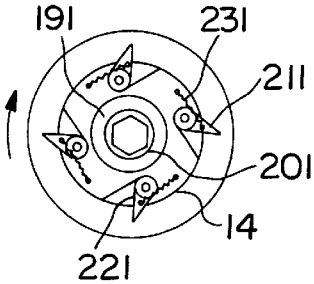
Figure 16C:
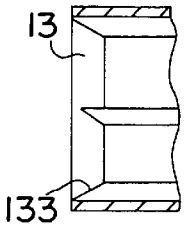

FIGS. 14 to 16 show fitting modes of the drive source coupling 13 and the driven coupling 14. In FIG. 14, the driven coupling 14 is fitted at its front end with a sleeve-like clutch 131 having a plurality of projecting teeth. This clutch 131 is constructed so as to be non-rotatable and slidable in the axial direction relative to the shaft 31 via a slide key 171. In FIG. 14, numeral 181 designates a compression spring for biasing the sleeve-like clutch 131 toward the shaft end direction and numeral 191 designates a stopper plate for the clutch 131 fixed to the shaft end via a bolt 201. On the printing machine side, there is provided at a fixed position a drive source coupling 13 having grooves 141 to be engaged with the projecting teeth at the front end portion of the clutch 131.

The ink feeder having the couplings is mounted at a predetermined position of the printing machine so that axes of both couplings 13, 14 coincide with each other. Upon start of a motor, the projecting teeth portion of a front end of the drive source coupling 13 first rotates slippingly by an amount of phase deviation. When the respective phase of both couplings 13, 14 coincides with each other, the driven coupling 14 is moved toward the shaft end side by a pressing force of the compression spring 181 and both couplings 13, 14 are coupled securely. Thus, a rotational drive force can be transmitted from the printing machine side to the ink pump 10 side.

In FIG. 15, a driven coupling 14 is fitted at an end portion of the shaft 31 with a clutch 142 having several projecting teeth of spline shapes around its outer circumference. This clutch 142 is constructed so as to be non-rotatable and slidable in the axial direction relative to the shaft 31. A compression spring 181 biases the clutch 142 toward the shaft end direction. The structure and function of a stopper plate 191 and a bolt 201 are the same as those mentioned with respect to FIG. 14. Each end portion of the projecting teeth of the clutch 142 is formed in a sharp shape.

A drive source coupling 13 has grooves 132 on its inner circumference so that the projecting teeth on the outer circumference of the clutch 142 engage therewith. In this case, as in FIG. 14, the clutch 142 is moved toward the shaft end direction by the spring force of the compression spring 181 so as to engage with the grooves 132 of the drive source coupling 13. As each end portion of the projecting teeth of the clutch 142 is worked to form a sharp end, even if both projecting teeth strike each other, the clutch 142 and the grooves 132 can engage with each other securely by rotation of the drive source coupling 13 with a sufficient time for engagement.

In FIG. 16, the driven coupling 14 fitted to the shaft end of the vane wheel 9 comprises a clutch 143 having one or more turnable claws 211 in the circumferential direction. In the figure, numeral 191 designates a stopper plate for the clutch 143 fixed to the shaft end of the vane wheel 9 via a bolt 201. The turnable claw 211 is constructed so as to be turnable to a predetermined angle around a fulcrum shaft 221. Numeral 231 designates a tension spring provided between the turnable claw 211 and the clutch 143 for biasing the turnable claw 211 so as to cause it to come out of the circumferential direction.

The drive source coupling 13 on the printing machine side is formed as a cylindrical bore having one or more grooves 133 to engage the turnable claw 211. An inlet portion of the cylindrical bore is tapered so that its inner diameter becomes smaller toward a depth-wise direction of axis.

In the ink feeder comprising the couplings shown in FIG. 16, as the ink feeder approaches in a manner so that the axes of both couplings 13, 14 coincide with each other, the turnable claws 211 are pushed toward a center of the shaft 31 along the taper formed at the front end of the drive source coupling 13 on the printing machine side. Upon start of a motor, slippage of both couplings 13, 14 occurs by an amount of phase deviation. When the groove 133 of the drive source coupling 13 and the turnable claw 211 of the driven coupling 14 coincide with each other, the turnable claw 211 is caused to project outside in a radial direction by the spring force of the tension spring 231 and a centrifugal force acting on the turnable claw 211. Thus, both couplings 13, 14 are coupled securely and a rotational force becomes transmittable. In this case, therefore, slide movement of the driven coupling 13 in the axial direction becomes unnecessary.

In FIG. 12, the shaft end portion of the vane wheel 9 on the opposite side of the shaft from the driven coupling 14 is connected to the ink pump 10 fitted to the side face of the ink tank 2. The discharge side of the ink pump 10 is connected to an ink feed nozzle 511 via the ink feed pipe 11. In the figure, numeral 151 designates a support element fitted to a portion of the detachable unit via a bracket 161. The ink feed blade 12 is fitted to the support element 151.

In the ink feeder, ink change is made by attaching and detaching the driven coupling 14 to and from the drive source coupling 13 in the axial direction. During the change, the entire ink feeder 100, which is integrated, is removed to the left hand side of FIG. 12 to be replaced with the ink feeder 100 of a new order. For this purpose, a positioning guide (not shown) is provided for guiding the ink feeder 100 to be fitted securely to a predetermined position, and a detachable lock mechanism (not shown) by which the ink feeder 100, after positioned, is fixed at the position is also provided.

In the printing machine comprising the ink feeder constructed as above, the ink feeder 100 is mounted at a predetermined position. The driven coupling 14 approaches to engage the drive source coupling 13 fixed to the printing machine side, and the motor connected to the drive source coupling 13 is started. Then the ink 2*a* in the ink tank 2 is moved toward the left hand side of FIG. 12 by rotation of the vane wheel 9 and is fed from the suction port of the ink pump 10 onto the surface of the ink fountain roller 1 via the ink feed pipe 11 and the ink feed nozzle 511.

In the present embodiment, the ink feeder 100 which comprises the ink tank 2, the ink pump 10, the ink feed pipe 11, the ink feed nozzle 511, the ink feed blade 12, etc., is made in a detachable integrated unit and is constructed so that surplus ink from the ink feed blade 12 portion and the ink feed nozzle 511 portion falls down to be recovered in the ink tank 2 positioned therebelow. Thus, no contamination of the surroundings during the ink change occurs, and attachment and detachment of the ink feeder unit can be accomplished within a short time.

Also, when cleaning the residual ink 2*a* at the ink feed nozzle 511 portion or the ink feed blade 12 portion, the ink feeder unit can be placed apart from the printing machine. Thus, the cleaning can be done safely, easily and sufficiently in a short time.

Figure 13:
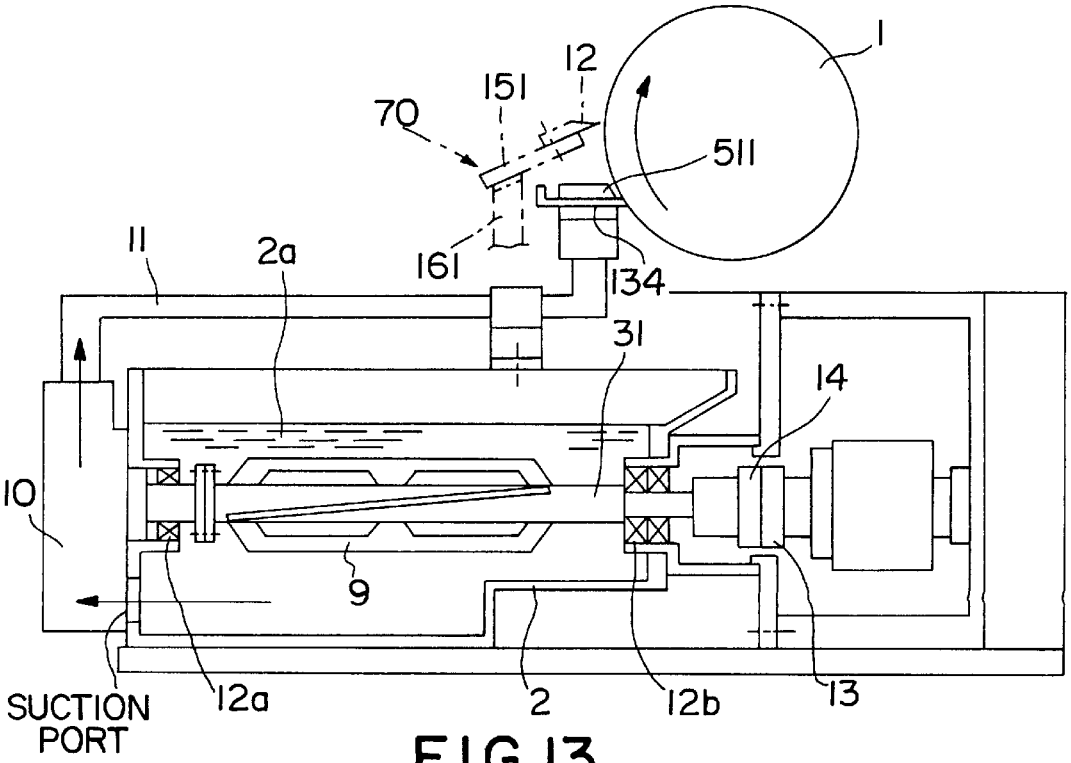
FIG. 13 is a cross sectional view of an ink feeder of a fourth embodiment according to the present invention.

FIG. 13 shows an ink feeder of a fourth embodiment according to the present invention. In this embodiment, an ink feed blade mechanism 70 portion which comprises the ink feed blade 12, the support element 151, the bracket 161, etc., is made in a separate unit. Also, a portion comprising the ink tank 2, the ink pump 10, the ink feed pipe 11, the ink feed nozzle 511, etc. is made in a detachable integrated unit and is constructed so that a surplus ink from the ink feed blade 12 and the ink feed nozzle 511 falls down to be recovered in the ink tank 2 disposed therebelow, as in the third embodiment. It is to be noted that the ink feed blade mechanism 70, constructed as a separate unit, may be fixed to the main body of the printing machine or may be made detachable relative to the main body of the printing machine.

In this fourth embodiment, the ink feed blade mechanism 70 portion which can be cleaned relatively easily is made in a separate unit. Thus, the printing machine can be made compact in size and lower in weight, and attachment and detachment of the ink feeder 100 becomes easier. Also, if the ink feed blade mechanism 70 is made detachable relative to the main body of the printing machine, cleaning of the residual ink becomes simplified, as in the ink feeder.

In the ink feeder according to each of the mentioned embodiments, because the drive source coupling 13 and the driven coupling 14 are connected automatically only by mounting the ink feeder at a predetermined position on the printing machine, no prior preparation to adjust the phase position of the engaging portions is needed, and time and labor for an ink change can be greatly saved.

It is to be noted that the drive source coupling 13 and the driven coupling 14 may be reversed. In other words, they may be swapped between the drive source side or the driven side, so as to be positioned differently from the mentioned embodiments.

Next, with reference to FIGS. 18 to 23, a fifth embodiment of the present invention is described.

Figure 18:
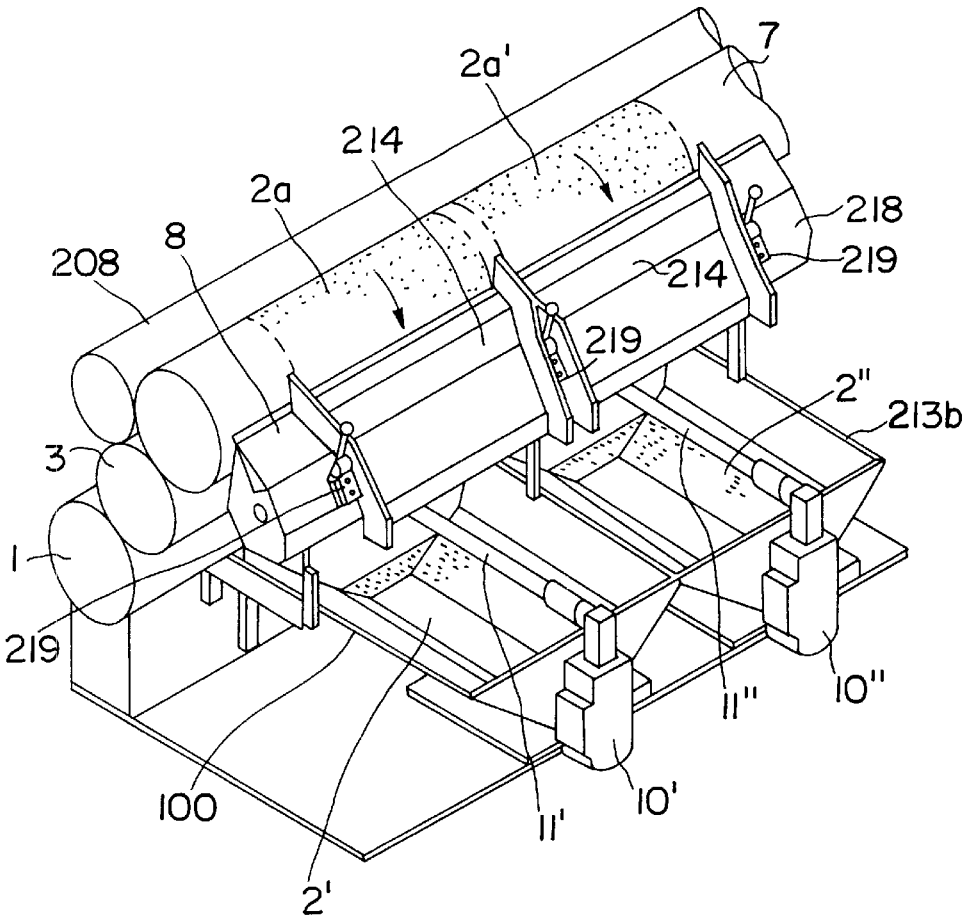
FIG. 18 is a schematic outside perspective view of an ink recovery portion in an offset press comprising a scraped ink separator of a fifth embodiment according to the present invention.
Figure 19A:
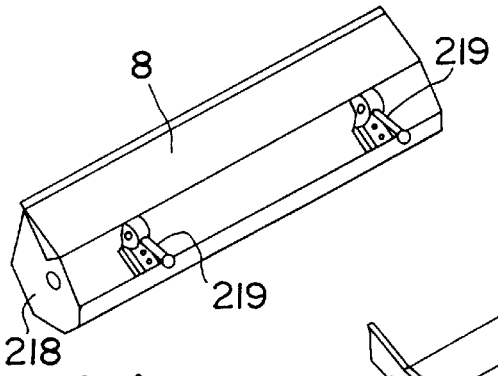
FIG. 19 is an outside perspective view showing the structure of the ink scraper of the fifth embodiment, wherein (A) shows the scraping doctor and (B) shows the scraped ink separator.
Figure 19B:
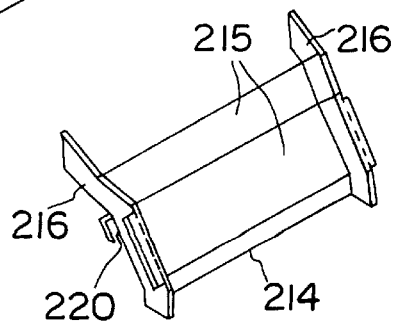
Figure 20:
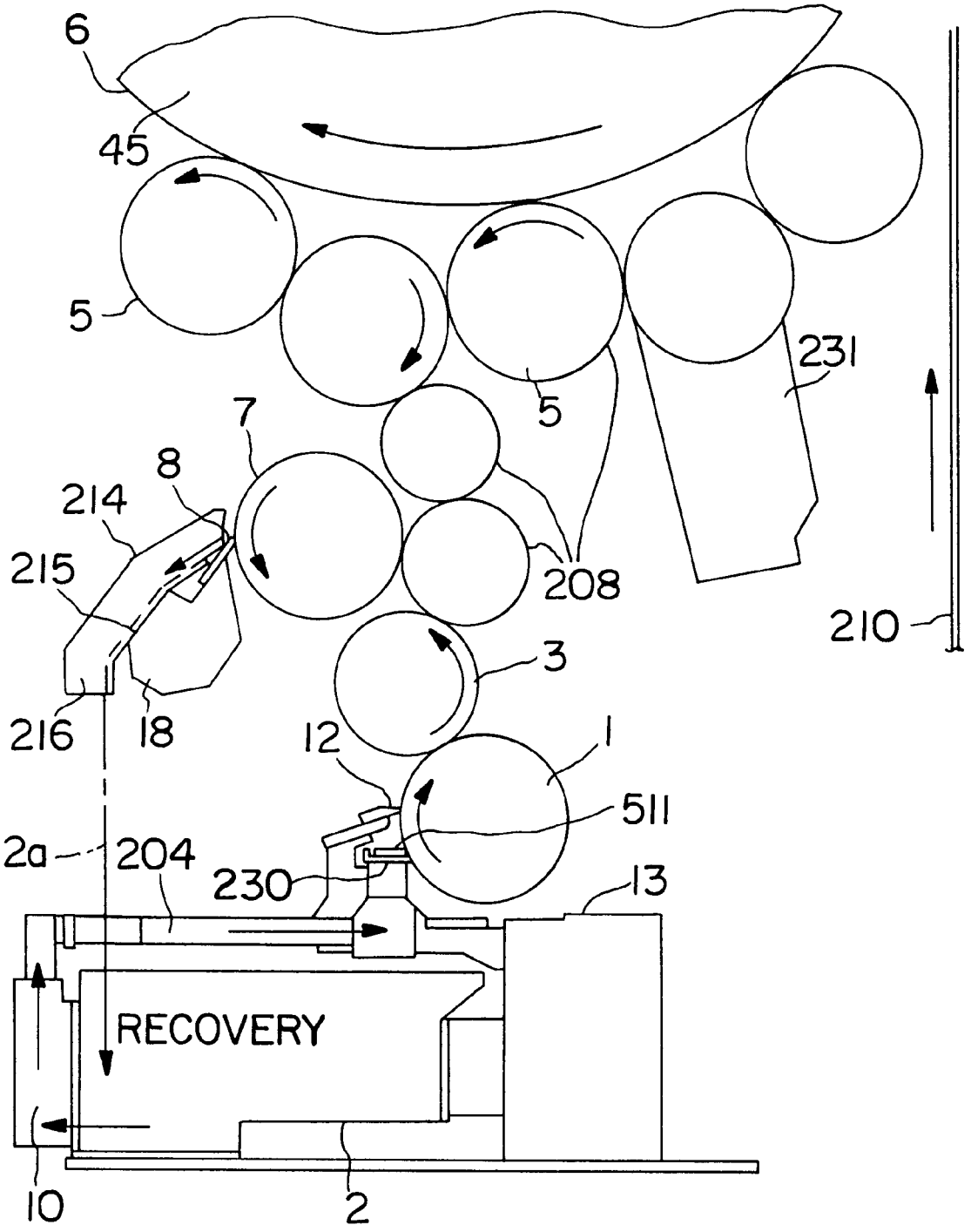
FIG. 20 is a structural view showing a fitting mode of the scraped ink separator.

The printing machine according to the present embodiment is constructed, as shown in FIGS. 18 to 20, such that ink 2*a* from an ink tank 2 (2', 2") of ink feeders arrayed in the cross machine direction is fed to an ink feed pipe 11 via an ink pump 10. The ink is fed to an ink fountain roller 1 via an ink feed nozzle 511 and further to a blanket cylinder (not shown) via an ink transfer roller 3 and an inking roller group. A predetermined printing is then applied to a paper 210 to which the ink 2*a* is transferred from the blanket cylinder. In this embodiment, an ink scraping doctor 8 portion is improved so that irregularity of the film thickness of the ink remaining after the printing (the ink having an image history sticking on a circumferential surface of a doctor roller 7) is made uniform so as to stabilize the sticking state of the ink which is being fed successively. The construction is made so that the printing is applied to plural sheets of paper at one time in the cross machine direction. Moreover, mixing of ink can be prevented when colors of ink of adjacent sheets are different from each other.

Herebelow, description is made in detail. In FIGS. 18 to 20, numeral 2 (2', 2") designates an ink tank, numeral 10 (10', 10") designates an ink pump, numeral 11 (11', 11") designates an ink feed pipe, numeral 511 designates an ink feed nozzle, numeral 1 designates an ink fountain roller, numeral 3 designates an ink transfer roller, numeral 4 designates an inking roller group, numeral 100 (100', 100") designates an ink feeder, numeral 45 designates a plate cylinder, numeral 6 designates a printing plate wound around the plate cylinder 45, numeral 12 designates an ink feed blade positioned to oppose an outer circumferential surface of the ink fountain roller 1, numeral 230 designates a scraper and numeral 231 designates a damping device.

The printing machine comprising devices shown in FIGS. 18 to 20 is of a type that applies a printing to four sheets (or two sheets) at one time, using two different colors of ink 2*a*. One color of ink is used for two sheets (pages 1 and 2) on the left hand side of FIG. 18 and one color of ink is used for two sheets (pages 3 and 4) on the right hand side of same. In the ink feeder 100, there are provided an ink feeder 100*a* for feeding ink 2*a* to the left hand side of FIG. 18 and an ink feeder 100*b* for feeding ink 2*a* to the right hand side of same of a different color from that fed to the left hand side. It is to be noted that if all the adjacent colors of ink are different from each other, four sets of the ink feeder 100*a* to 100*d* are arrayed in the cross machine direction.

In FIGS. 18 and 19, numeral 214 designates a scraped ink separator, provided in two sets in the axial direction of the rollers (the cross machine direction), abutting the doctor roller 7. The scraped ink separator 214 comprises an ink leading plate 215 having a color mixing prevention wall 216 fixed to each end thereof to form a channel. The scraped ink separator 214 is positioned near the scraping doctor 8 so as to cover the scraping doctor 8. A front end of the color mixing prevention wall 216 is cut out in an arcuate form which is concentric with the doctor roller 7 so as to connect to the tip of a scraping doctor supporting device 218 and to stand closely to an outer circumference of the doctor roller 7, as shown in FIG. 22.

Figure 22:
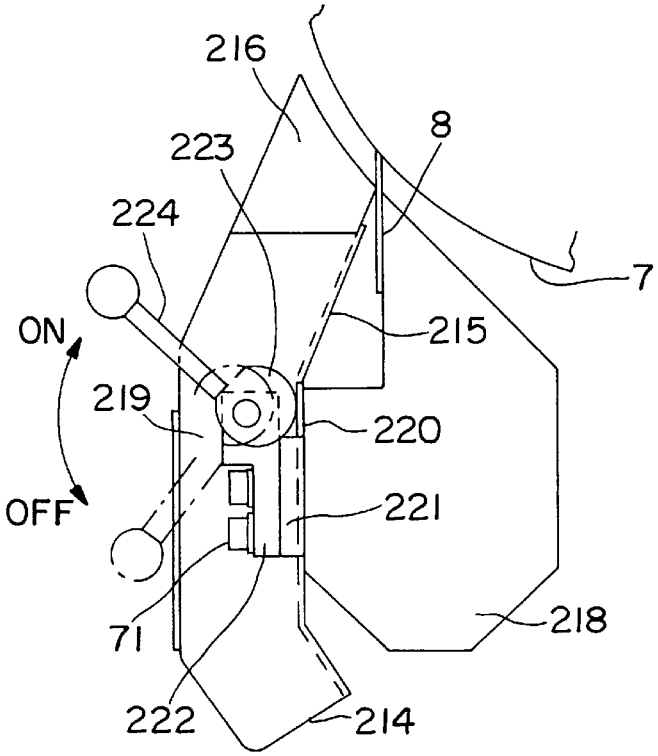
FIG. 22 is a view taken in arrow Z direction of FIG. 21.

The scraped ink separator 214 is constructed, as shown in FIGS. 18 and 22, such that a flow-out port for the ink flowing on the ink leading plate 215 is positioned above the ink tank (ink tank 2', for example) corresponding to that scraped ink separator 214. Therefore, the scraped ink 2*a* flows smoothly in to the ink tank.

Figure 21:
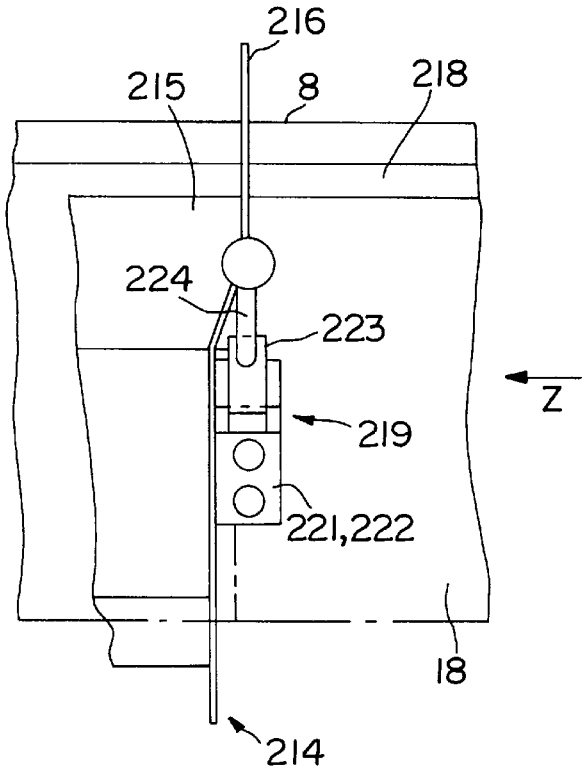
FIG. 21 is an explanatory front view on a method of attachment and detachment of the scraped ink separator.

Also, the scraped ink separator 214 is constructed, as shown in FIGS. 21 and 22, to be detachable from the scraping doctor supporting device 218 via a bolt 71. That is, in FIG. 18 and in FIGS. 21 and 22, the scraped ink separator 214 is inserted between clamp devices 219, 219 and fixed to the scraping doctor supporting device 218. The scraped ink separator 214 is positioned in the rightward and leftward direction and in the upward and downward direction by a fitting plate 220 connected to the ink leading plate 215 caused to abut a patch 221 at both its side ends and lower end.

The clamp device 219 is constructed such that an eccentric cam 223 is supported by bearing on a bracket 222 fixed to the patch 221. A lever 224 fitted to an outer peripheral surface of the eccentric cam 223 is turned so that the eccentric cam 223 is rotated, thereby changing the radial directional dimension fixing or releasing the scraped ink separator 214. By using the clamp device 219 as so constructed, the fitting plate 220 is pressed and removably fixed to the scraping doctor supporting device 218 by the eccentric cam 223 connected to the lever 224 of the clamp device 219.

Figure 23A:
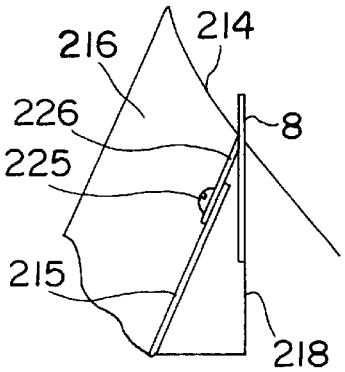
FIG. 23 is an explanatory view showing structural examples of an ink leading portion of a tip of the scraped ink separator, wherein (A) is one example of a tip of the scraped ink separator, (B) is a second example of a tip of the scraped ink separator, and (C) is a third example of a tip of the scraped ink separator.
Figure 23B:
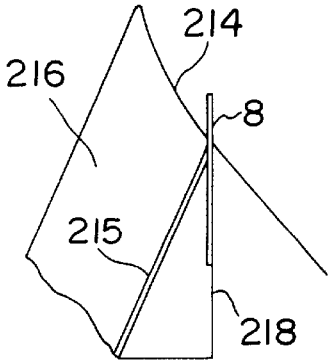
Figure 23C:
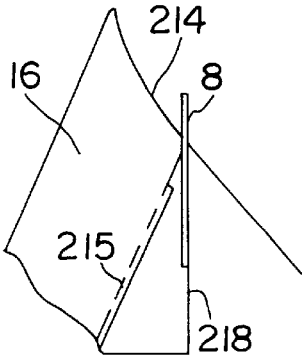
Figure 24:
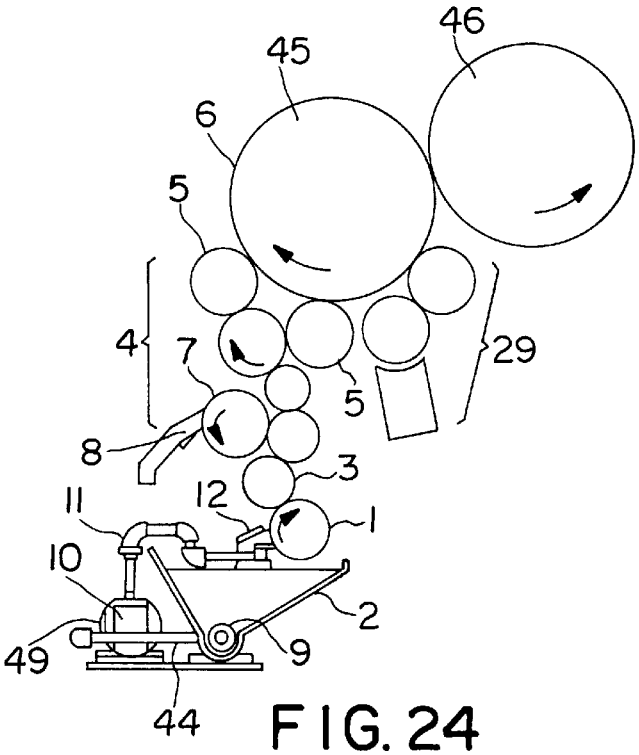
FIG. 24 PRIOR ART
FIG. 24 is a partial side view showing structure of an offset rotary press in the prior art.
Figure 25:
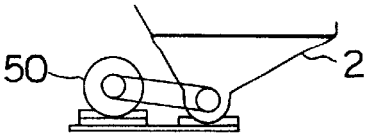
FIG. 25 PRIOR ART
FIG. 25 is a side view showing a prior art drive device for a vane wheel in an ink tank.
Figure 26:
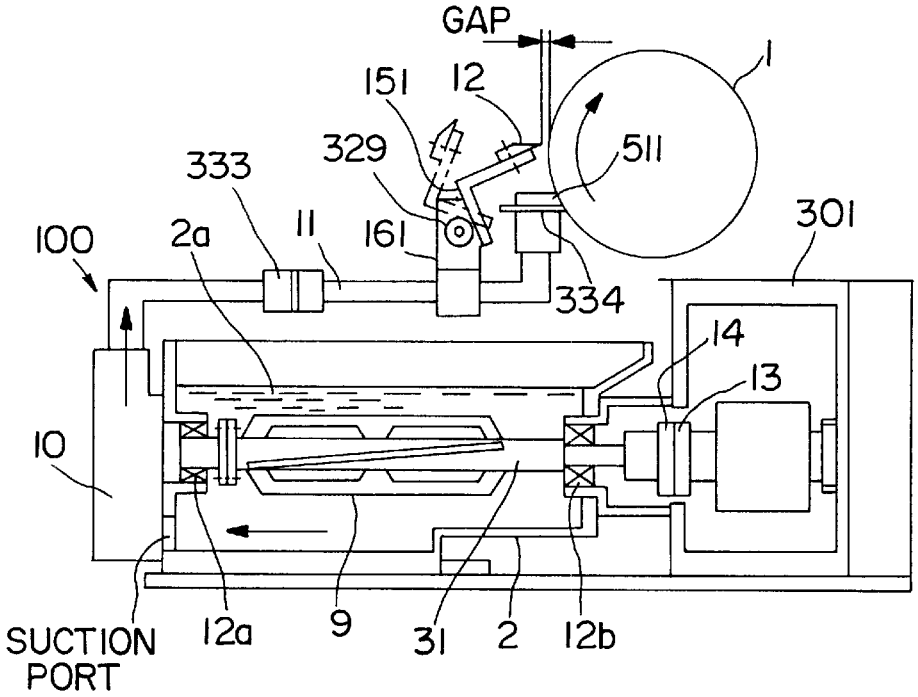
FIG. 26 PRIOR ART
FIG. 26 is a detailed cross sectional view showing one example of a prior art ink feeder.
Figure 27:
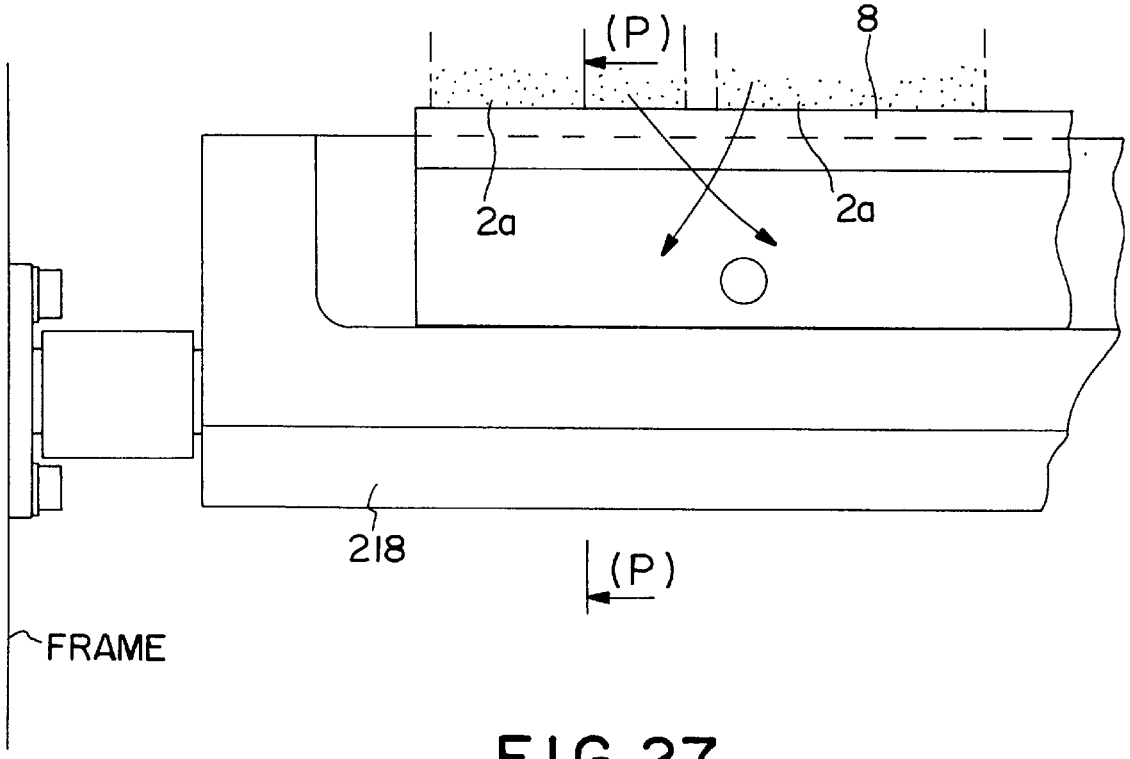
FIG. 27 PRIOR ART
FIG. 27 is a front view of a prior art ink scraping doctor portion.
Figure 28:
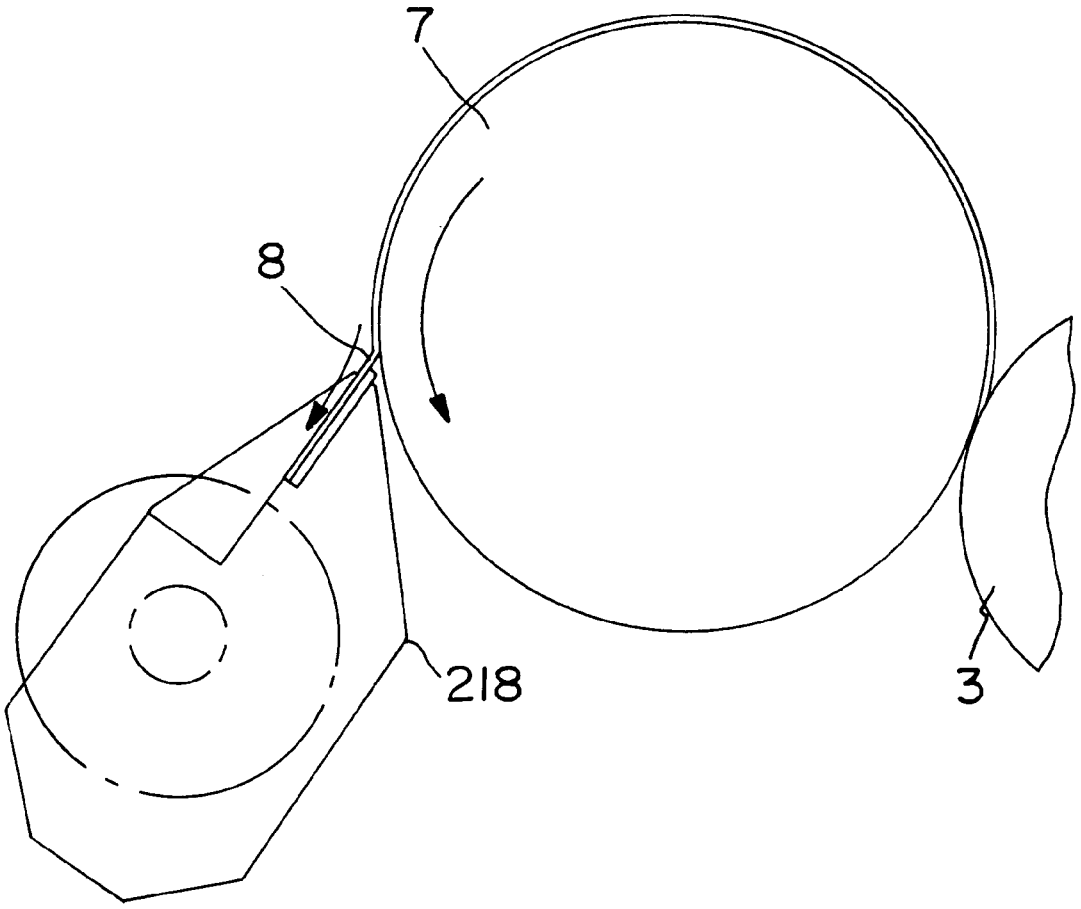
FIG. 28 PRIOR ART
FIG. 28 is a side view of a prior art ink scraping doctor portion.

FIGS. 23(A) to (C) show shapes of a side end portion of the scraping doctor 8, the ink leading plate 215, and the scraped ink separator 214. In FIG. 23 (A), a thin plate spring 226 as a leading member of the scraped ink separator is fitted to a tip portion of the ink leading plate 215 by a machine screw between a front end of the ink leading plate 215 and an outer circumferential surface of the doctor roller 7.

In this case, the tip of the plate spring 226 can be sufficiently approach the tip of the scraping doctor 8 by the effect of a spring force of the thin plate spring 226. Therefore, there is less residual ink on the scraping doctor supporting device 218 when the scraped ink separator 214 is detached for an ink color change, and cleaning thereof becomes easier.

In FIG. 23(B), a front end of the ink leading plate 215 is tapered to form an acute angle and abuts the tip of the scraping doctor supporting device 218. In this case, the structure of the scraped ink separator 214 becomes simplified, there is relatively little residual ink on the scraping doctor supporting device 218 at the time of color change, and cleaning thereof becomes easier.

In FIG. 23(C), a cut out portion is formed on the scraping doctor supporting device 218 so as to correspond to a plate thickness of the ink leading plate 215 and the scraped ink separator 214 is fitted there. In this case, when the ink 2*a* scraped from the outer circumferential surface of the doctor roller 7 is led to the ink leading plate 215, the scraped ink 2*a* won't be prevented from flowing due to deformation of the ink separator 214 since the ink separator 214 is of a thin plate structure having less rigidity in the plate thickness direction.

In the printing machine comprising the scraped ink separator as constructed above, the scraping doctor 8 is mounted at a predetermined position and the tip of the scraped ink separator 214 fixed to the scraping doctor supporting device 218 engages with the surface of the scraping doctor supporting device 218. Consequently, surplus ink 2*a*, 2*a'* sticking on the outer circumferential surface of the doctor roller 7 is scraped by the scraping doctor 8 and flows into the scraped ink separator 214. An ink color boundary portion separates each color by the color mixing prevention wall 216 provided on each side of the scraped ink separator 214, and the ink flows down on the ink leading plate 215.

The ink 2*a*, 2*a'* scraped from the surface of the doctor roller 7 is, as shown in FIG. 20, recovered in the ink tank 2 without being mixed with the adjacent ink.

Also, by using of the clamp device 219 as shown in FIGS. 21 and 22, the scraped ink separator 214 can be positioned accurately in the upward and downward direction and in the rightward and leftward direction only by abutting the patch 221. The scraped ink separator 214 can be fixed securely only by the lever 224 being shifted up and down, and detachment thereof also can be done easily.

Also, by the functions mentioned above, when color change is to be done frequently due to the object to be printed, the time needed for color change and for resetting can be shortened. In addition, since the cleaning work of the scraped ink can be done apart from the main body of the printing machine, productivity can be enhanced greatly.

By providing a scraped ink separator 214 and ancillary devices as mentioned above, mixing of adjacent different colors of ink in the cross machine direction can be prevented, and the scraped ink can be efficiently recovered in a corresponding ink tank 2. It is to be noted that the scraped ink separator 214 may be made of various materials, such as a thin steel plate, an aluminum plate, or plastics. Therefore, the devices can be lowered in weight, and workability in the attachment and detachment thereof can be enhanced.

INDUSTRIAL APPLICABILITY

The present invention relates to an ink feeder in a printing machine in which ink is fed from an ink pump via an inking roller group to a printing cylinder having a printing plate wound around an outer circumference thereof. It also relates to an ink scraper for scraping residual ink sticking on an outer circumference of each inking roller. The ink feeder and ink scraper are applicable generally to rotary type printing machines including, but not limited to, an offset rotary press.

What is claimed is:

1. An apparatus comprising:

an ink fountain roller;

at least one ink tank assembly positioned along said ink fountain roller;

said at least one ink tank assembly having an ink tank, an ink pump, and a vane wheel;

an ink transfer roller positioned adjacent to said ink fountain roller such that said ink fountain roller is capable of feeding ink onto said ink transfer roller;

a roller group including a plurality of rollers, said roller group being positioned adjacent to said ink transfer roller such that said ink transfer roller is capable of feeding ink onto said roller group;

a printing plate positioned adjacent to said roller group such that said roller group is capable of feeding ink onto said printing plate;

said roller group having a doctor roller;

at least one scraping doctor positioned adjacent to said doctor roller such that said at least one scraping doctor is capable of scraping residual ink from said doctor roller;

said ink tank being positioned below said at least one scraping doctor such that said ink tank receives ink scraped by said at least one scraping doctor;

said ink tank having a suction port;

said vane wheel being positioned at a bottom portion of said ink tank;

said vane wheel including a drive shaft;

said ink pump being attached to said drive shaft of said vane wheel;

said ink pump being attached to said suction port of said ink tank such that ink flows from said ink tank to said ink pump through said suction port;

an ink feed pipe positioned between said ink pump and said ink fountain roller such that ink flows from said ink pump to said ink fountain roller through said ink feed pipe;

at least one ink feed blade assembly including an ink feed blade;

said ink feed blade assembly being positioned adjacent to said ink fountain roller such that a gap is formed between said ink feed blade and said ink fountain roller; and said drive shaft of said vane wheel being connected to a drive source.

2. The apparatus of claim 1, wherein said ink feed blade assembly further includes a fitting plate, said ink feed blade being adjustably fastened to said fitting plate such that said gap between said ink feed blade and said ink fountain roller is adjustable.

3. The apparatus of claim 2, further comprising an integrated ink feed blade unit positioning guide having a lock mechanism, wherein an integrated ink feed blade unit is formed including said ink feed blade, said fitting plate, and an ink receiving member having an ink feed hole, said ink feed blade unit being removably fastened to said ink feed blade unit positioning guide at a predetermined position.

4. The apparatus of claim 3, wherein said ink feed blade unit further includes a refresh doctor positioned adjacent to said ink fountain roller such that said refresh doctor scrapes said ink fountain roller upstream of said ink feed hole.

5. The apparatus of claim 1, further comprising an integrated ink feed blade unit positioning guide having a lock mechanism, wherein an integrated ink feed blade unit is formed including said ink feed blade, a fitting plate, and an ink receiving member having an ink feed hole, said ink feed blade unit being removably fastened to said ink feed blade unit positioning guide at a predetermined position.

6. The apparatus of claim 5, wherein said ink feed blade unit further includes a refresh doctor positioned adjacent to said ink fountain roller such that said refresh doctor scrapes said ink fountain roller upstream of said ink feed hole.

7. The apparatus of claim 1, wherein said ink feed pipe includes a damping water emulsifying device.

8. The apparatus of claim 1, further comprising an integrated ink tank unit positioning guide having a lock mechanism, wherein said ink tank, ink pump, vane wheel, and ink feed pipe form an integrated ink tank unit, said ink tank unit being removably fastened to said ink tank unit positioning guide at a predetermined position.

9. The apparatus of claim 8, further comprising a driven coupling positioned on an end of said drive shaft, a drive coupling connected to a motor, said driven coupling engaging said drive coupling when said ink tank unit is mounted at a predetermined position.

10. The apparatus of claim 8, further comprising a secondary drive shaft connected to a motor, said secondary drive shaft having a drive toothed gear, said drive shaft of said vane wheel having a driven toothed gear, said driven toothed gear engaging said drive toothed gear when said ink tank unit is mounted at a predetermined position.

11. The apparatus of claim 1, further comprising a driven coupling positioned on an end of said drive shaft, a drive coupling connected to a motor, said driven coupling engaging said drive coupling when said ink tank is mounted at a predetermined position.

12. The apparatus of claim 1, further comprising a secondary drive shaft connected to a motor, said secondary drive shaft having a drive toothed gear, said drive shaft of said vane wheel having a driven toothed gear, said driven toothed gear engaging said drive toothed gear when said ink tank is mounted at a predetermined position.

13. An apparatus comprising:

a doctor roller;

at least one ink scraper assembly positioned adjacent to said doctor roller;

said at least one ink scraper unit including a scraping doctor, a scraping doctor supporting member supporting said scraping doctor, and a scraped ink separator having a first end and a second end opposite said second end;

said scraped ink separator including an ink leading plate, a first color mixing prevention wall positioned along a side of said ink leading plate, a second color mixing prevention wall positioned along a side of said ink leading plate opposite said first color mixing prevention wall such that said second color mixing prevention wall forms a channel with said first color mixing prevention wall and said ink leading plate;

said first end of said scraped ink separator positioned adjacent to said scraping doctor such that ink scraped by said scraping doctor is lead away by said scraped ink separator.

14. The apparatus of claim 13, further comprising an ink tank positioned below said second end of said scraped ink separator.

15. The apparatus of claim 14, wherein said at least one ink scraper assembly further includes a clamp device for removably fastening said scraped ink separator to said scraping doctor supporting member.

16. The printing machine of claim 13, wherein said at least one ink scraper assembly further includes a clamp device for removably fastening said scraped ink separator to said scraping doctor supporting member.

* * * * *